US006363586B1

(12) United States Patent
Neufingerl

(10) Patent No.: US 6,363,586 B1
(45) Date of Patent: Apr. 2, 2002

(54) SET OF PARTS FOR RIGIDLY INTERCONNECTING THE CORNERS OF TWO PROVIDED WITH HOLLOW CORNER FITTINGS, TOOLS THEREFORE, AND ASSEMBLY SYSTEM

(76) Inventor: Horst Neufingerl, Jaffeestr. 14, D-21109 Hamburg (DE)

( * ) Notice: Subject to any disclaimer, the term of this patent is extended or adjusted under 35 U.S.C. 154(b) by 0 days.

(21) Appl. No.: 09/242,376

(22) PCT Filed: Aug. 11, 1997

(86) PCT No.: PCT/EP97/04357

§ 371 Date: Feb. 12, 1999

§ 102(e) Date: Feb. 12, 1999

(87) PCT Pub. No.: WO98/06644

PCT Pub. Date: Feb. 19, 1998

(30) Foreign Application Priority Data

| | | |
|---|---|---|
| Aug. 12, 1996 | (DE) | 196 32 471 |
| Sep. 6, 1996 | (DE) | 196 36 294 |
| Sep. 27, 1996 | (DE) | 196 39 903 |
| Dec. 18, 1996 | (DE) | 196 52 817 |
| Jan. 10, 1997 | (DE) | 197 00 678 |
| Apr. 16, 1997 | (DE) | 197 15 910 |

(51) Int. Cl.[7] ..... B65D 21/02
(52) U.S. Cl. ..... 24/287; 220/1.5; 220/23.4
(58) Field of Search ..... 24/287; 403/45, 403/43; 220/23.4, 1.5; 410/79, 78, 77, 82, 94, 95; 411/389

(56) References Cited

U.S. PATENT DOCUMENTS

| | | | | | |
|---|---|---|---|---|---|
| 260,366 | A | * | 7/1882 | Burr | 403/45 X |
| 2,972,175 | A | * | 2/1961 | Abolins et al. | 24/287 X |
| 3,052,941 | A | * | 9/1962 | Abolins et al. | 24/287 |
| 3,261,070 | A | * | 7/1966 | Abolins et al. | 24/287 X |
| 3,746,377 | A | * | 7/1973 | De Neveu et al. | 24/287 |
| 4,081,219 | A | * | 3/1978 | Dykmans | 403/43 |
| 4,729,707 | A | * | 3/1988 | Takahashi | 403/43 X |
| 5,065,688 | A | * | 11/1991 | Moody | 410/47 X |

* cited by examiner

*Primary Examiner*—Allan N. Shoap
*Assistant Examiner*—Joseph C. Merek
(74) *Attorney, Agent, or Firm*—R. W. Becker & Associates; R. W. Becker

(57) ABSTRACT

A kit for rigidly connecting two containers provided at their corners with hollow corner fittings (4) has a spacer portion (120) which, when containers are rigidly connected together, ensures a predetermined spacing between them, a screwthreaded rod (116) provided at its end regions with screwthreads, and two hammer portions (118) which can be screwed onto respective ends of the screwthreaded rod and which can be introduced into the interior of the corner fittings through a slot (14) at the side surfaces of the corner fittings (4). In the condition of being assembled for rigidly connecting the containers, the screwthreaded rod (116) passes through the spacer portion (120), it is rotatable from outside the spacer portion and, upon rotation thereof, it moves the hammer portions (118) arranged in the corner fittings and engaging same towards each other, whereby the outsides of the corner fittings (4) are pressed against the spacer portion (120).

11 Claims, 19 Drawing Sheets

Figure 1:
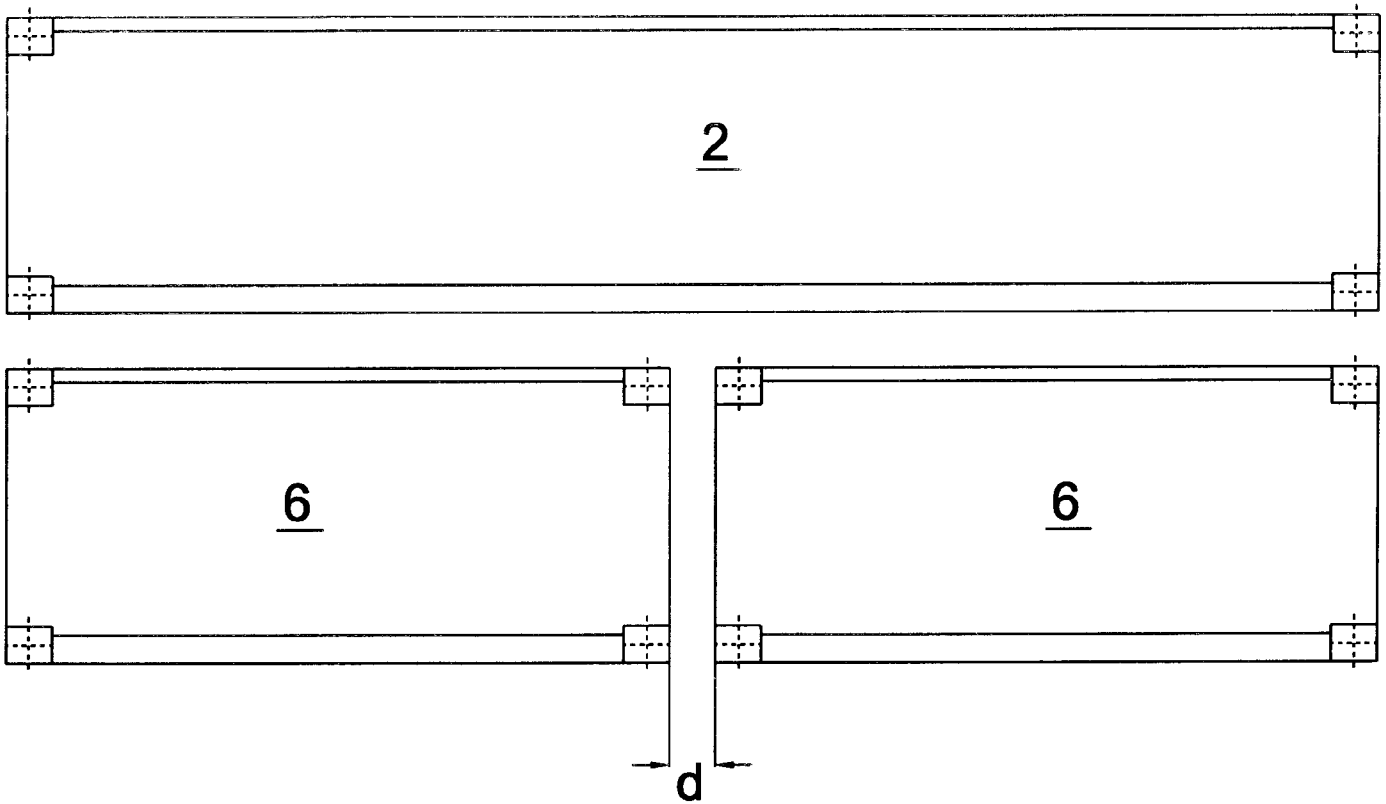

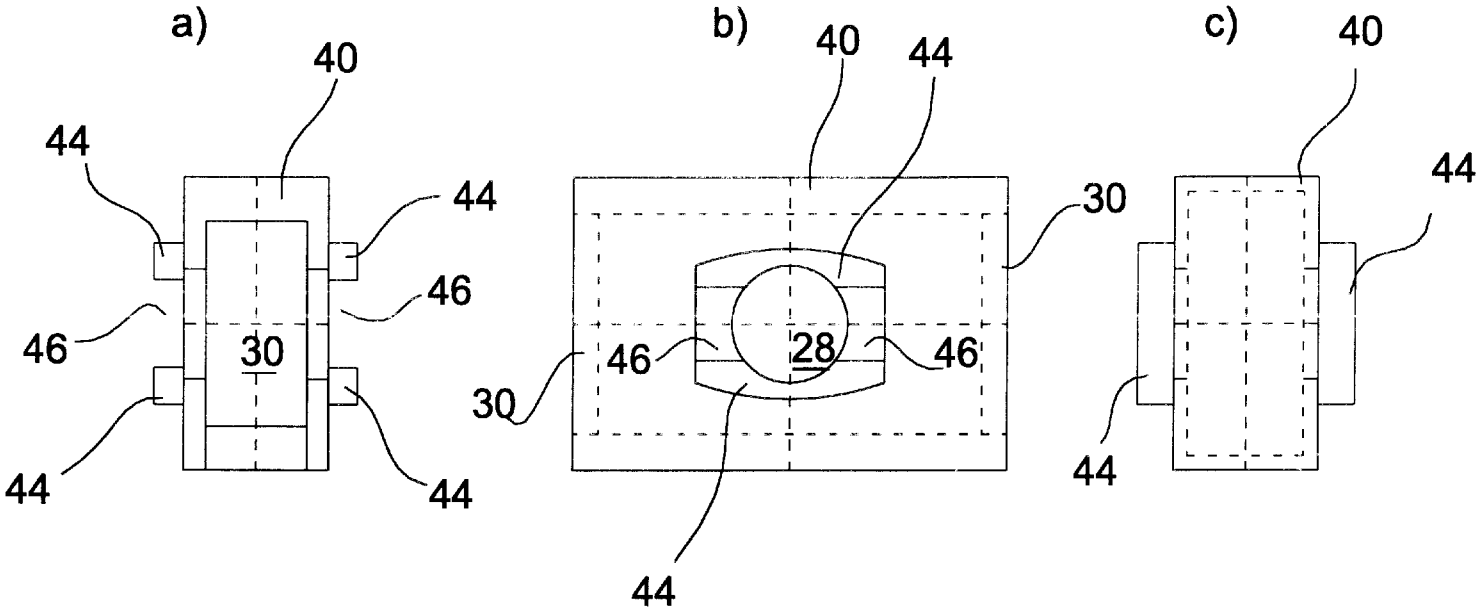
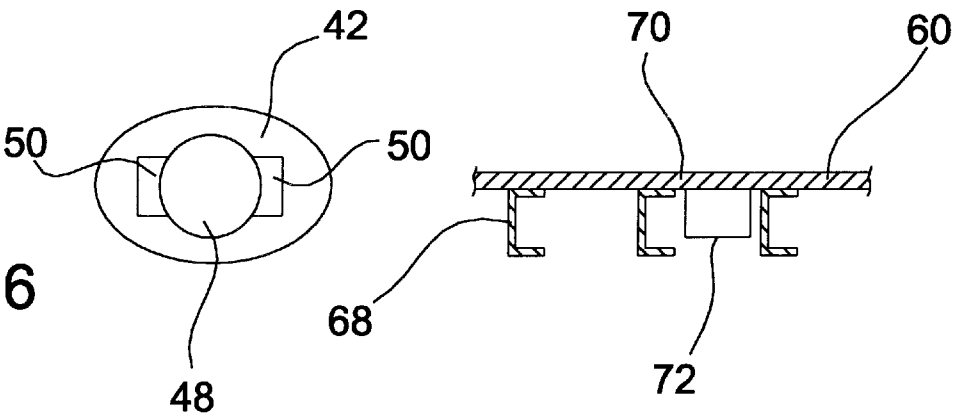
FIG.6
FIG.8 b)

a)

b)

a)

b)

a)

FIG. 23
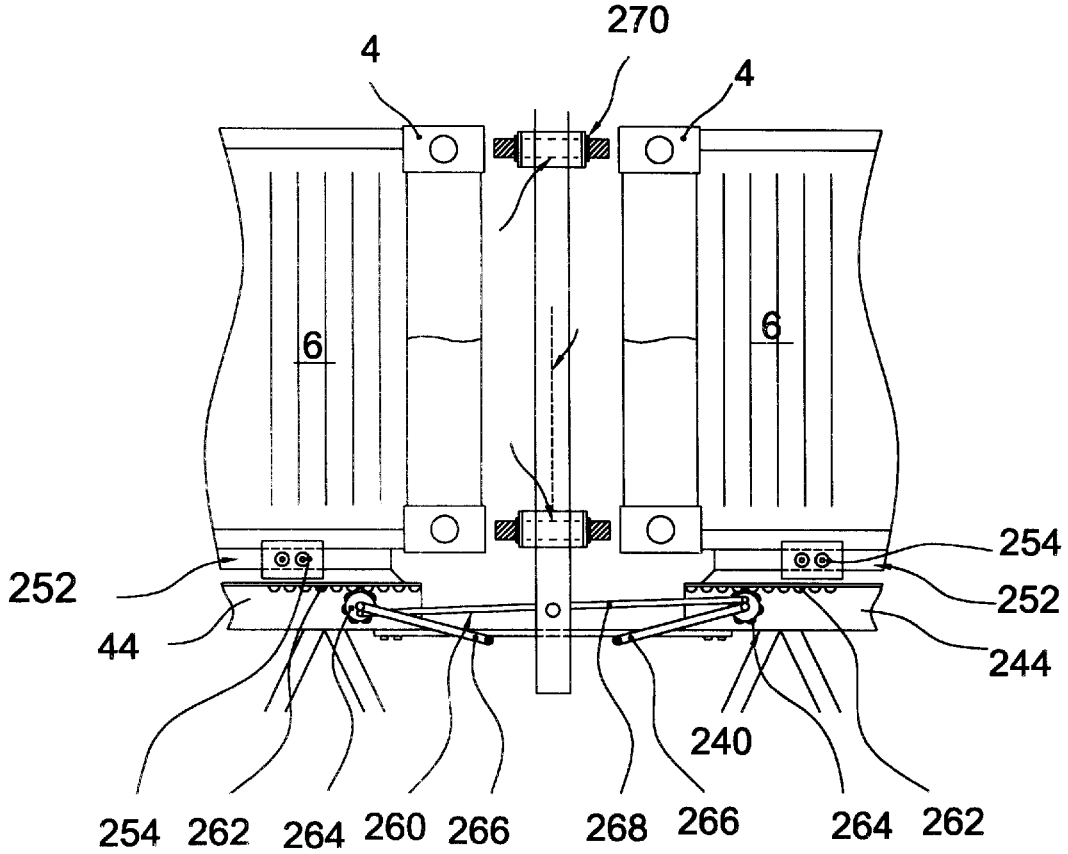
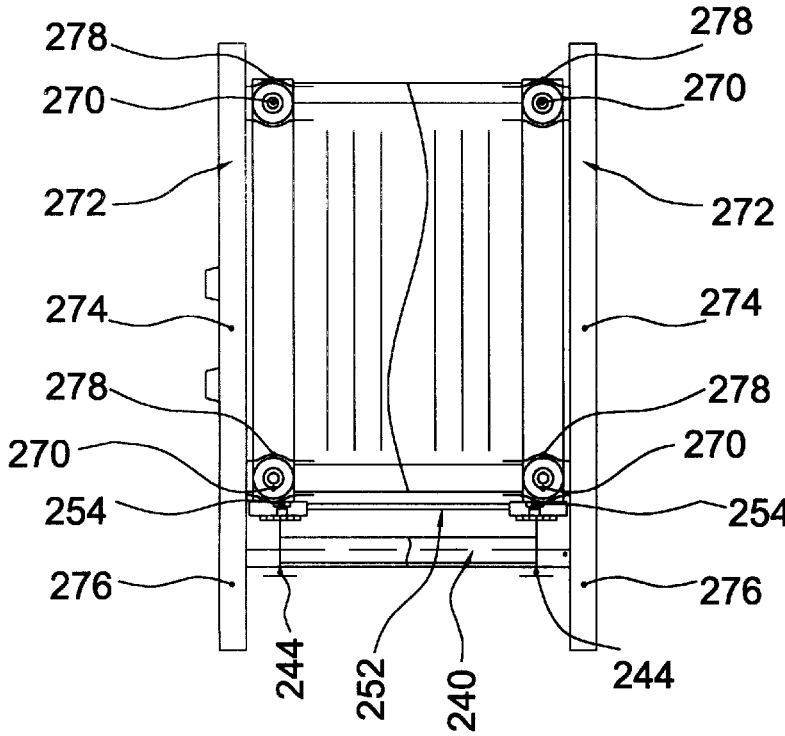
FIG. 24

SET OF PARTS FOR RIGIDLY INTERCONNECTING THE CORNERS OF TWO PROVIDED WITH HOLLOW CORNER FITTINGS, TOOLS THEREFORE, AND ASSEMBLY SYSTEM

The invention concerns a kit for rigidly connecting two containers provided in their corners with hollow corner fittings, as set forth in the classifying portion of claim 1. The invention further concerns a handling tool for such kits, a container and an apparatus for rigidly connecting containers as set forth in the classifying portion of claim 23.

The major part of piece goods freights or bundle freights are conveyed nowadays in containers, particularly in sea freight traffic. Introduced on the basis of ISO-standards, 20-foot and 40-foot sea containers are designed for ships, carrying apparatuses, lifting means, port installations and the like.

A problem which frequently occurs in practice is that in a respective terminal such as a port, loading station and the like, the existing 20-foot containers and 40-foot containers do not correspond to the respective requirement involved, in other words, they have to be transported to and fro in an empty condition, in order to have small and large containers, or 20-foot or 40-foot containers, available as required at the respective terminal. That transportation in an empty condition gives rise to considerable costs. In addition, the degree to which the containers are used to capacity falls, and that also results in increased costs.

To remedy that problem, DE 43 29 355 C2 proposed a container which can be assembled to a second container of the same kind, to form a complete container of double the length. The two containers are connected together by locking devices which comprise an element for guiding a respective pin and a pin-receiving element and which are integrated into the end container frame structure of the two containers to be coupled together and which are distributed on the couplable end in such a way that the same respective kind of element is always arranged laterally of a notional vertical centre line which divides the couplable end, thus ensuring couplability to another similar container. The locking device provides a positively locking connection by means of the insertion of a projection, arranged on a pin, of the pin-guiding element of the one container, into the corresponding pin-receiving element of the other container, with subsequent locking by rotating and pressing the projection against the pin-receiving element.

The previously known apparatus has the following particular characteristics:

- the container assembled to double the length does not fit on lifting and carrier apparatuses, which are installed world-wide at the present time, for 20-foot and 40-foot sea containers in accordance with the ISO-Standard, as a spacing of about 76 mm is required between two 20-foot containers so that, in the coupled-together condition of the two 20-foot containers, the corner fittings thereof are at the same spacing as the outer corner fittings of a 40-foot container;
- extensive conversion operations are required on the containers as the locking elements must be fitted into the frame structure of the containers; and
- for connecting two containers together, a person must gain access to the interior of the container, which presupposes that the container is empty or temporarily partially unloaded; besides high costs, that causes additional problems in regard to customs laws and duties.

The object of the present invention is to render substantially superfluous transportation operations in the empty condition, which are required with the containers which are used at the present time on a world-wide basis, to rationalise storekeeping, and to reduce transportation costs.

That object is attained by the features of the main claim.

The kit according to the invention can be used for 20-foot containers which are employed world-wide and which are standardised in accordance with the ISO-Standard, without any modification to the containers, while two 20-foot containers which are rigidly connected by the kits according to the invention can be transported like a 40-foot container in the infrastructure which exists world-wide. The kit according to the invention is simple in its construction and is therefore expensive. The containers can be connected in a simple manner by means of the kits, by a procedure whereby the hammer portions are introduced into the corner fittings of the containers through the laterals slots of the corner fittings, then screwed to the screwthreaded rod, with the containers being moved towards each other by a displacement which is produced from the exterior, and are then drawn together by rotating the screwthreaded rod until the spacer portion is in a condition of firmly bearing against the corner fittings. There is no need for modifications to the containers, nor is it necessary to go into the interior of the containers.

Besides further advantages, the invention affords the following advantages:

- improved utilisation of the 20-foot containers;
- by virtue of the coupling procedure, two 20-foot containers can be moved as a 40-foot container on board a ship in 40-foot support structures or on 40-foot positioning locations, which reduces both the loading costs and also the transportation costs;
- transportation movements in the empty condition are reduced;
- the coupled 40-foot container can be loaded quickly as it is accessible from two sides;
- conversion, which is appropriate in individual cases, of the 20-foot containers in such a way that the ends thereof which are towards each other in the coupled condition can be opened can be effected in a simple manner without interventions in the carrier structure;
- no structural alterations whatsoever are required on existing lifting and transporting means;
- the kits according to the invention can also be advantageously used when lashing and securing the 20-foot containers on ships; and
- a composite container which is composed of two conventional 20-foot containers with the kit is safeguarded against pilferage if the door sides face towards each other.

Appendant claims 2 to 13 are directed to advantageous configurations of the kit according to the invention.

Claims 14 to 18 are directed to a handling tool which facilitates handling of the kits according to the invention when connecting and separating two containers.

Claims 19 to 22 characterise containers which are particularly well suited for use of the kit according to the invention.

It is only necessary to dispose two kits in each container, for example in a storage receptacle or bin in the container bottom, so that the world-wide stock of 20-foot containers can be used in the optimum manner and inexpensively.

Claim 23 is directed to an apparatus with which containers can be rigidly connected together to form a composite container in a particularly simple manner, using kits according to the invention.

Figure 2:
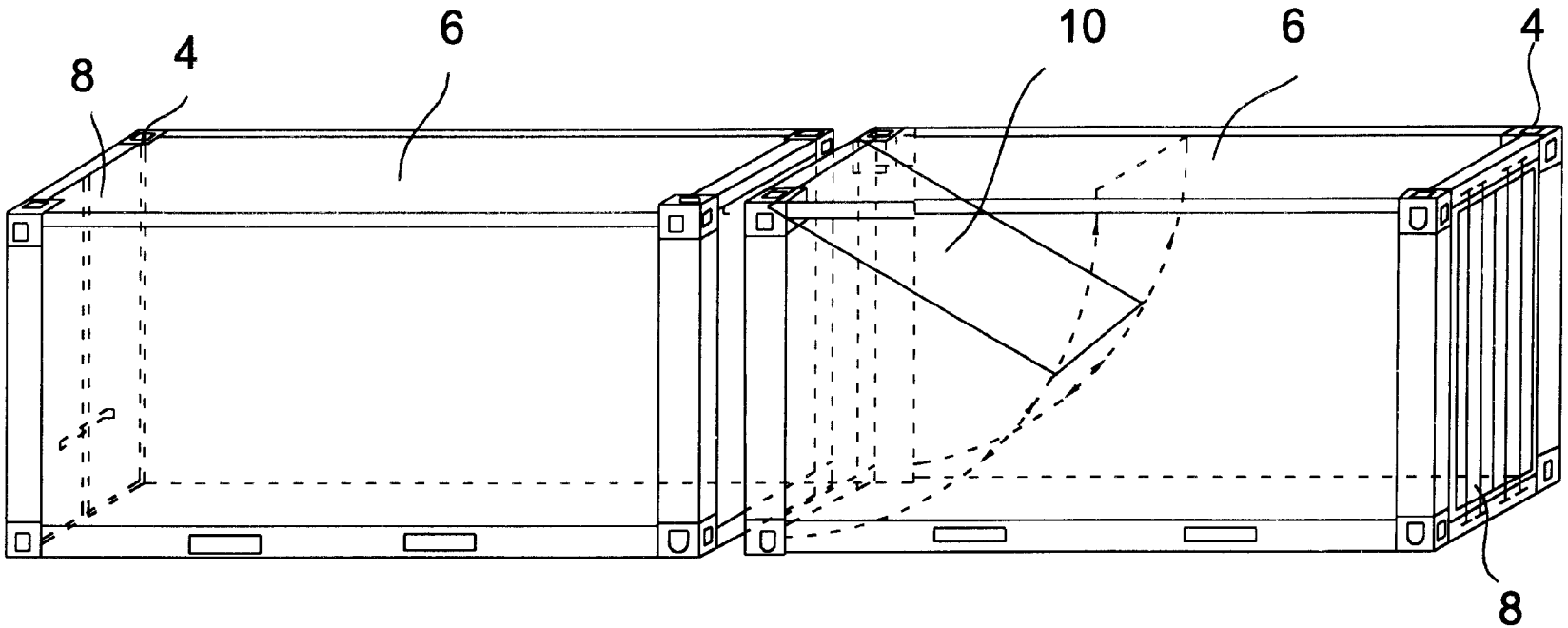
Figure 3:
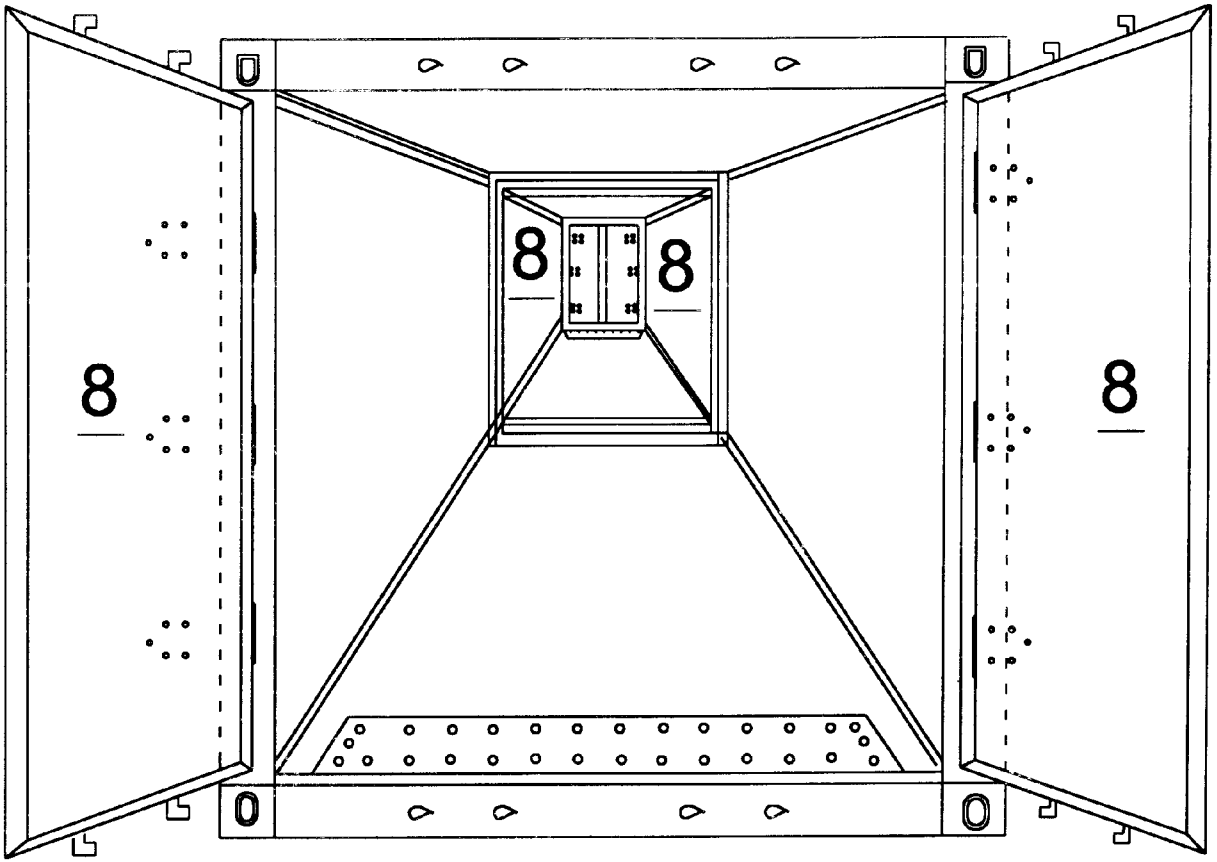
Figure 4:
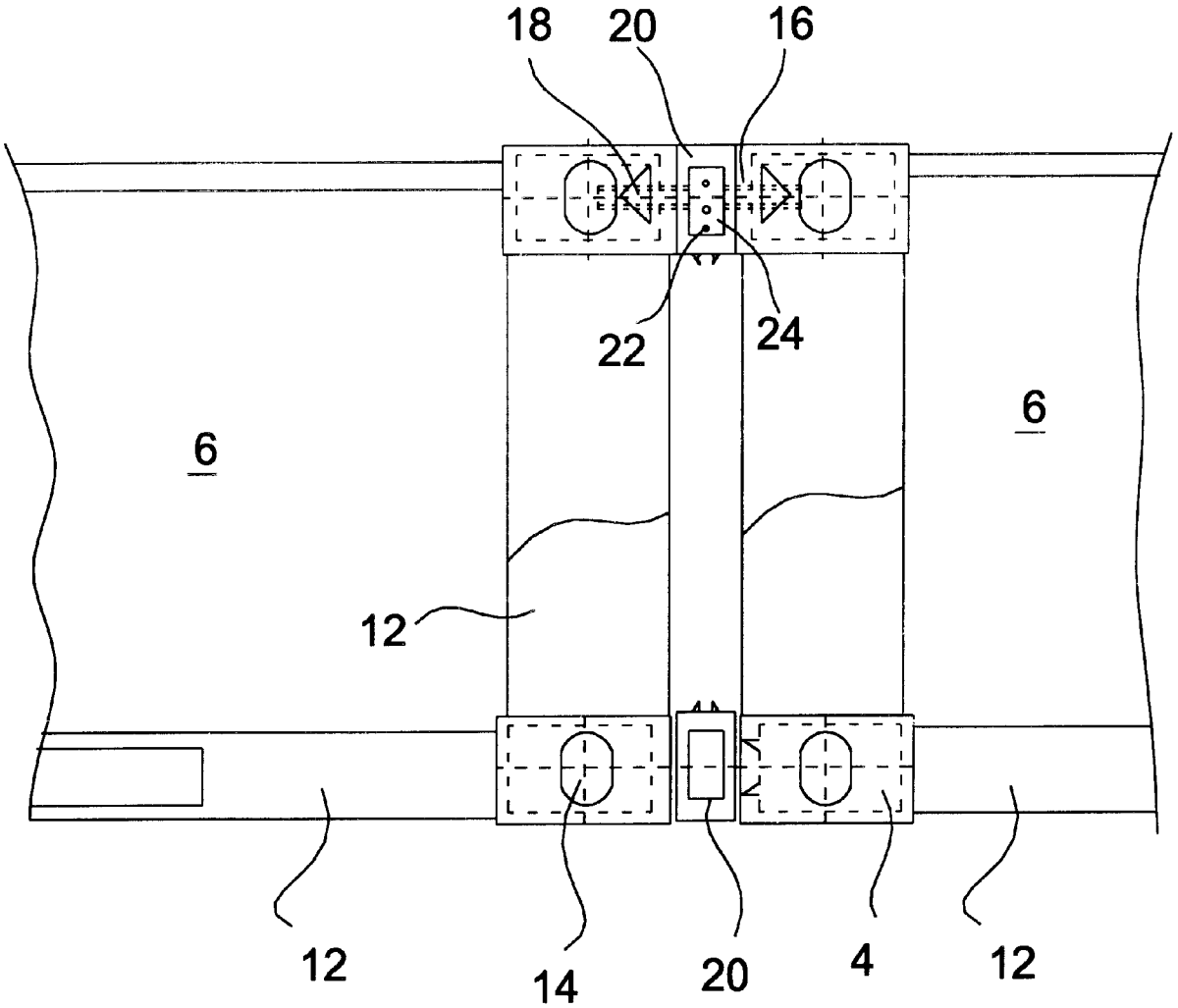
Figure 5:
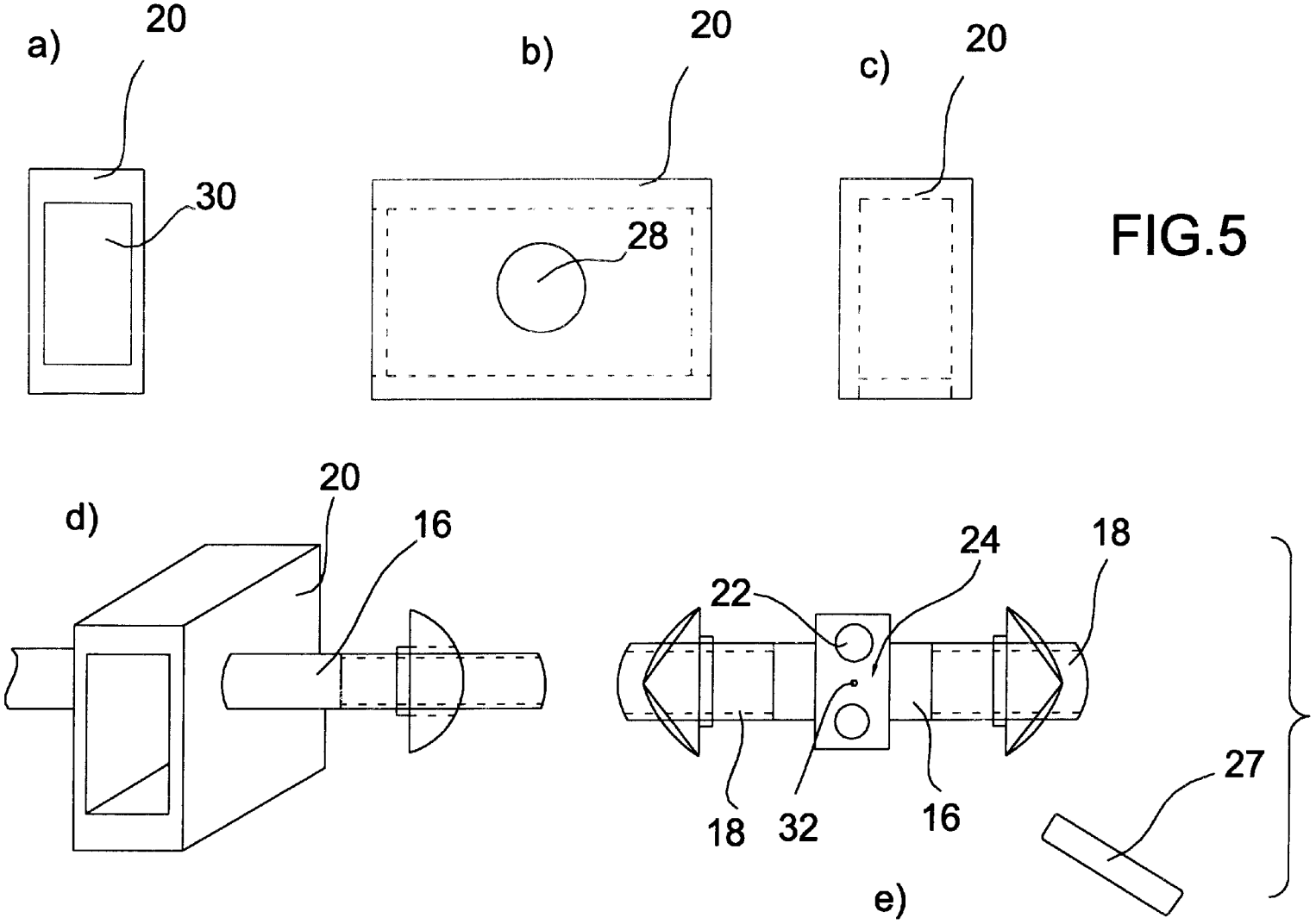
Figure 7:
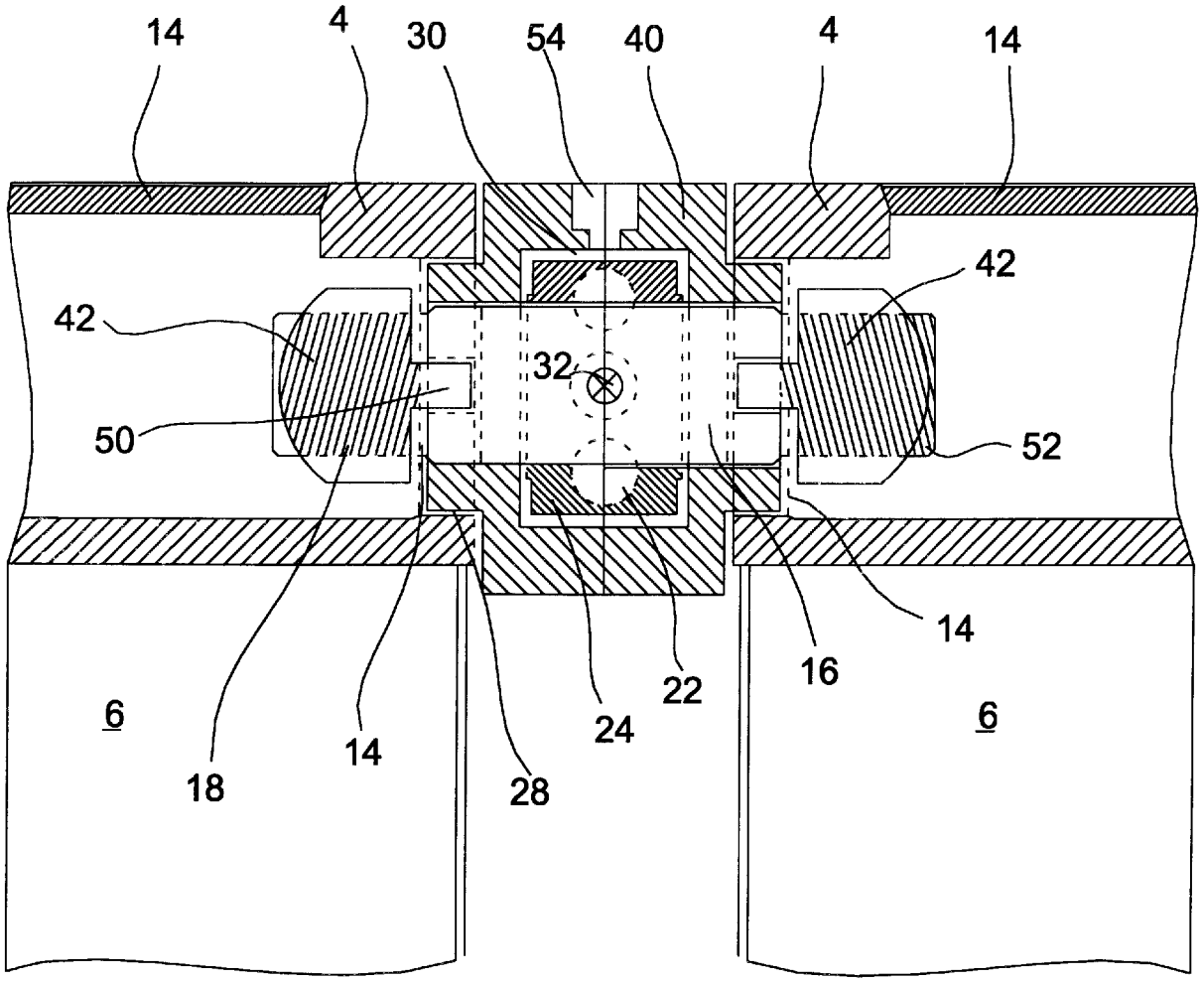
Figure 9:
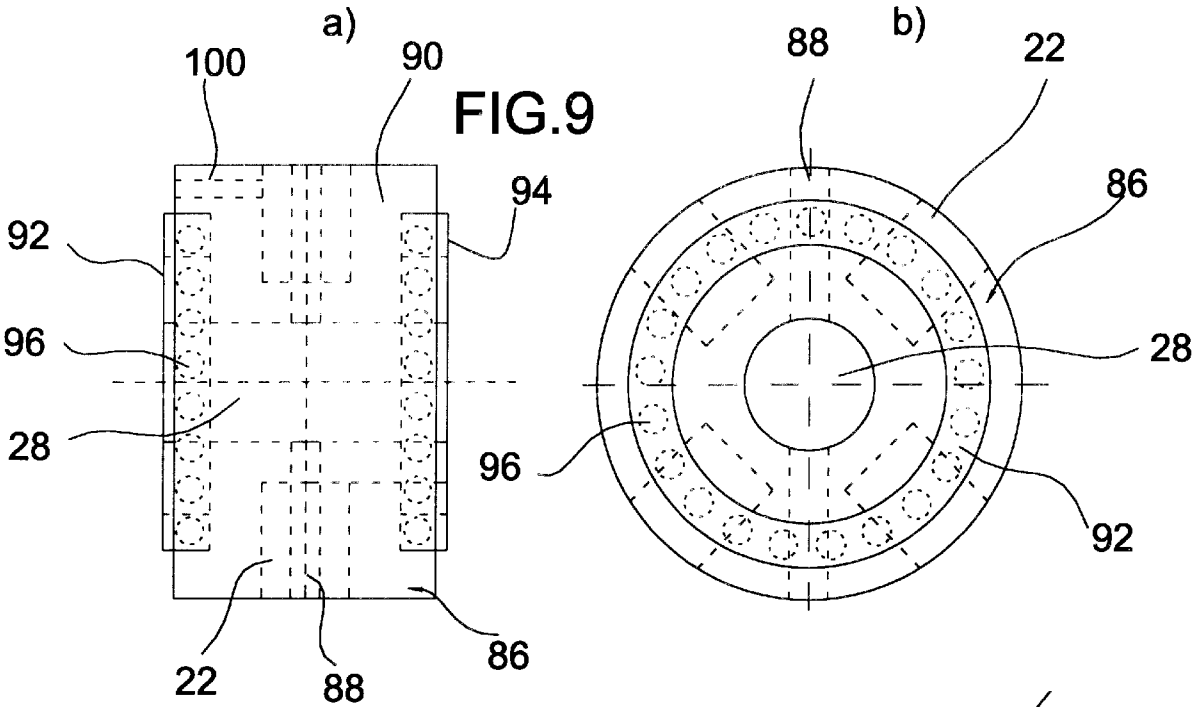
Figure 11:
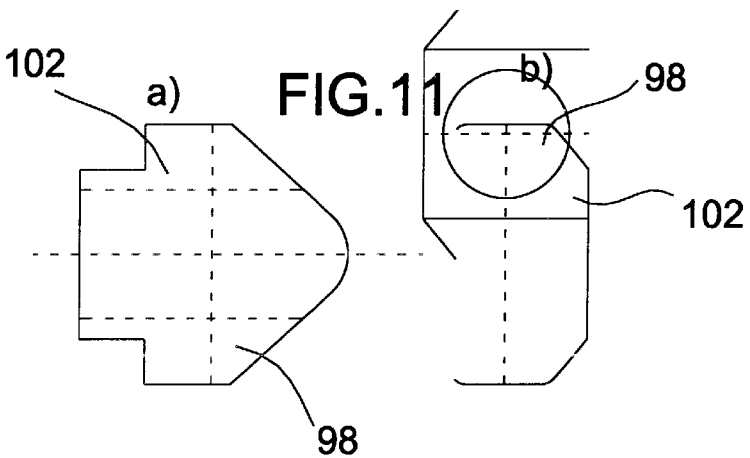
Figure 10:
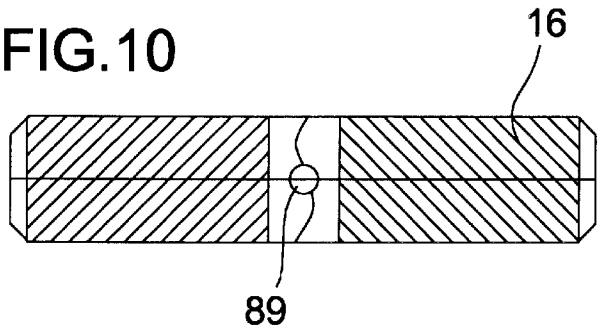
Figure 12:
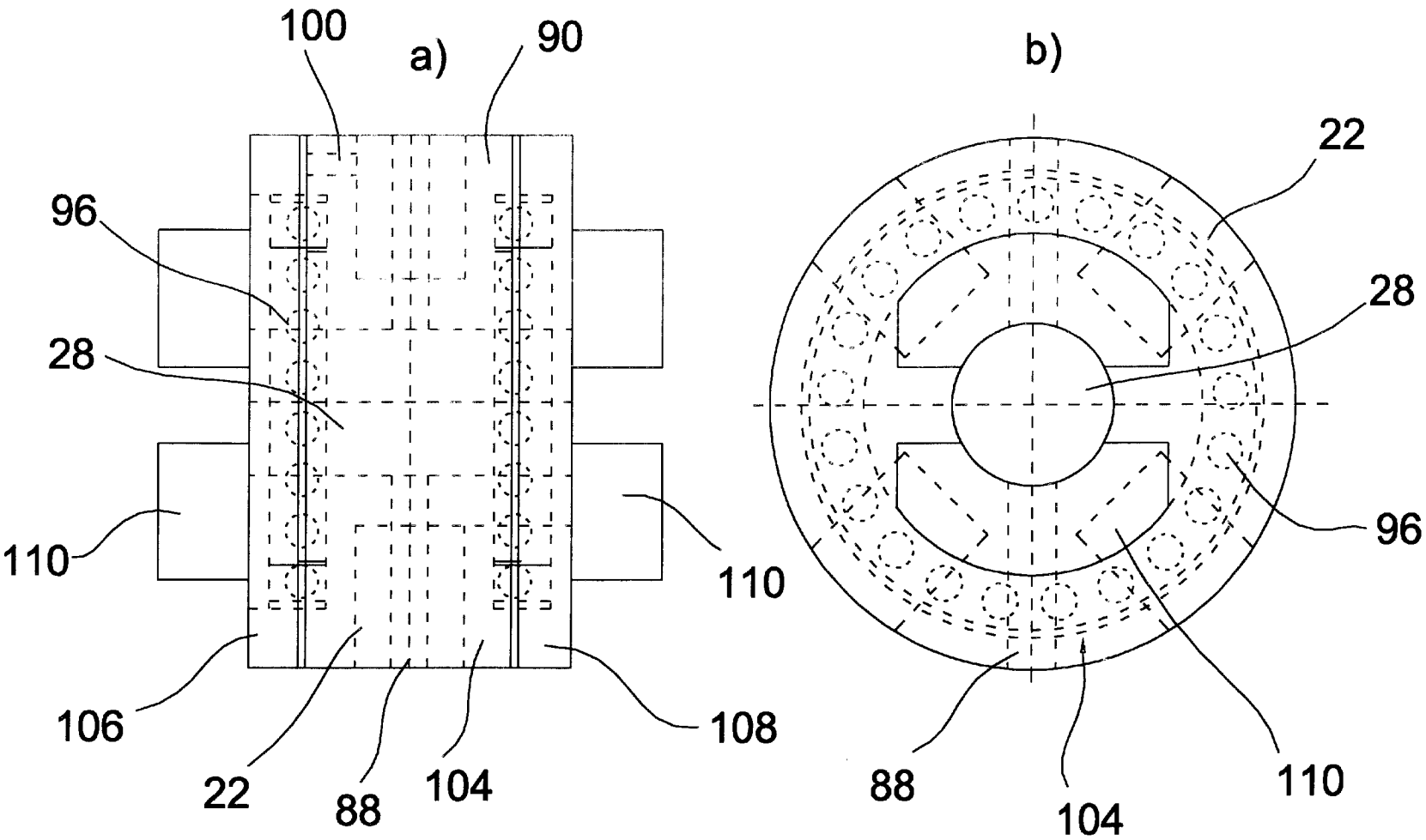
Figure 13:
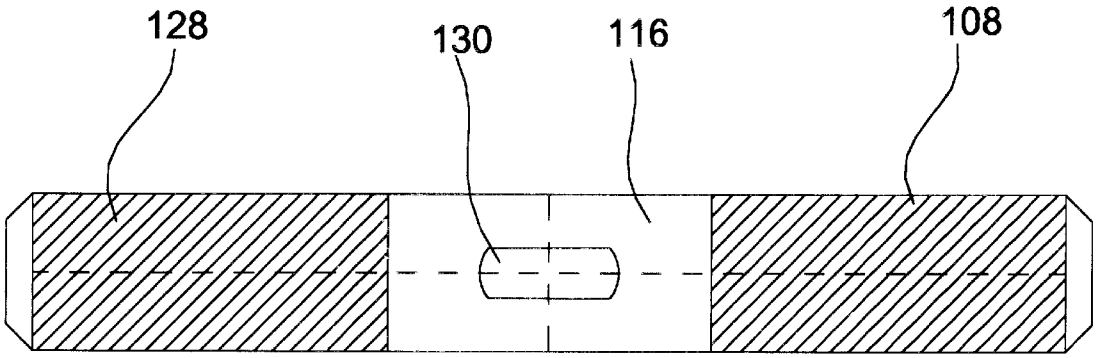
Figure 14:
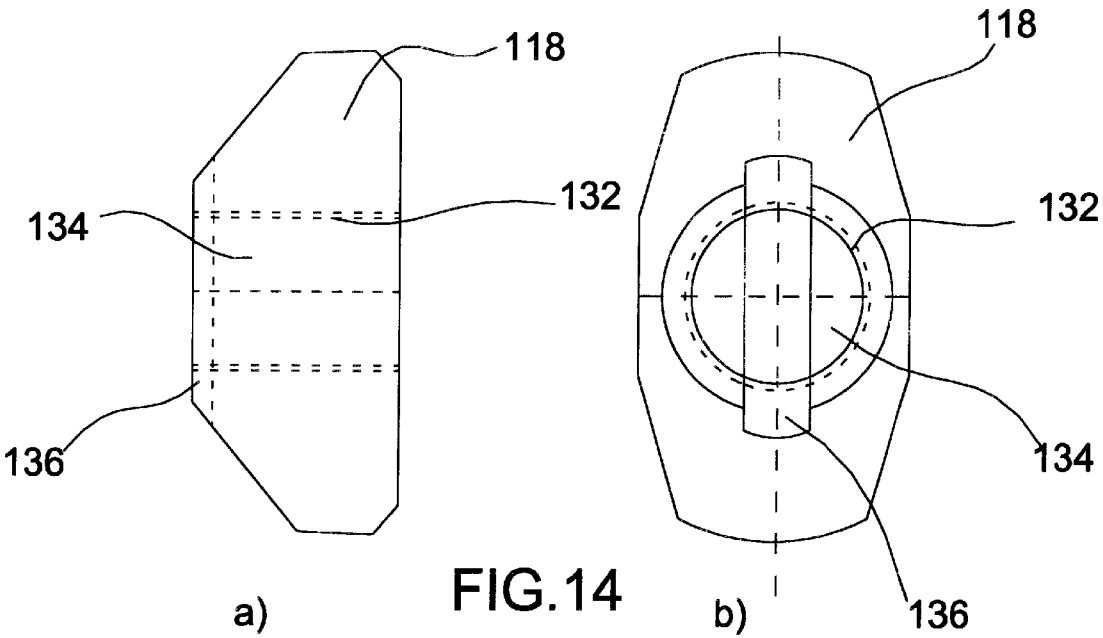
Figure 15:
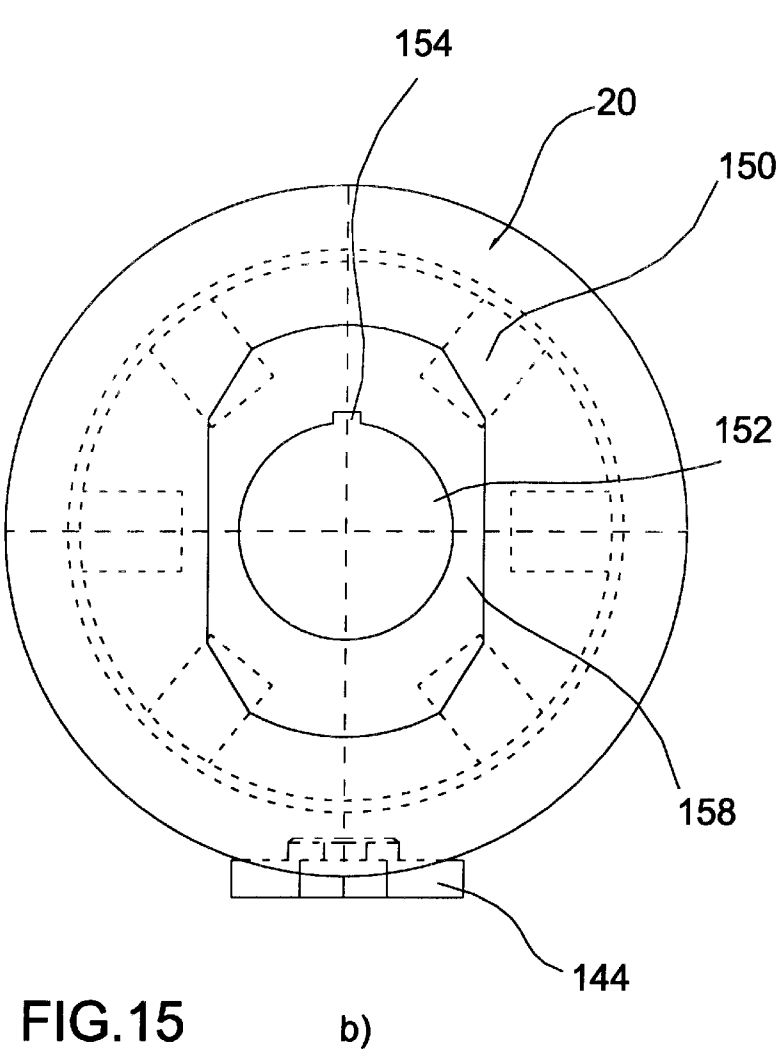
Figure 15:
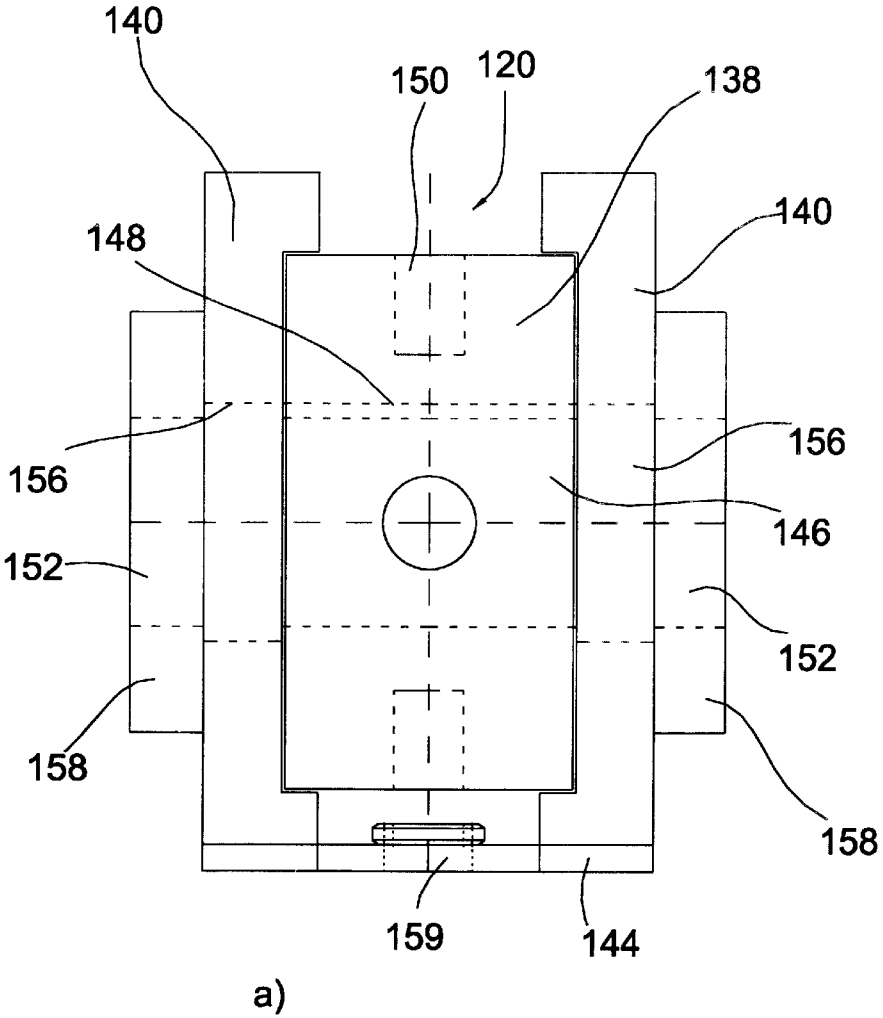
Figure 16:
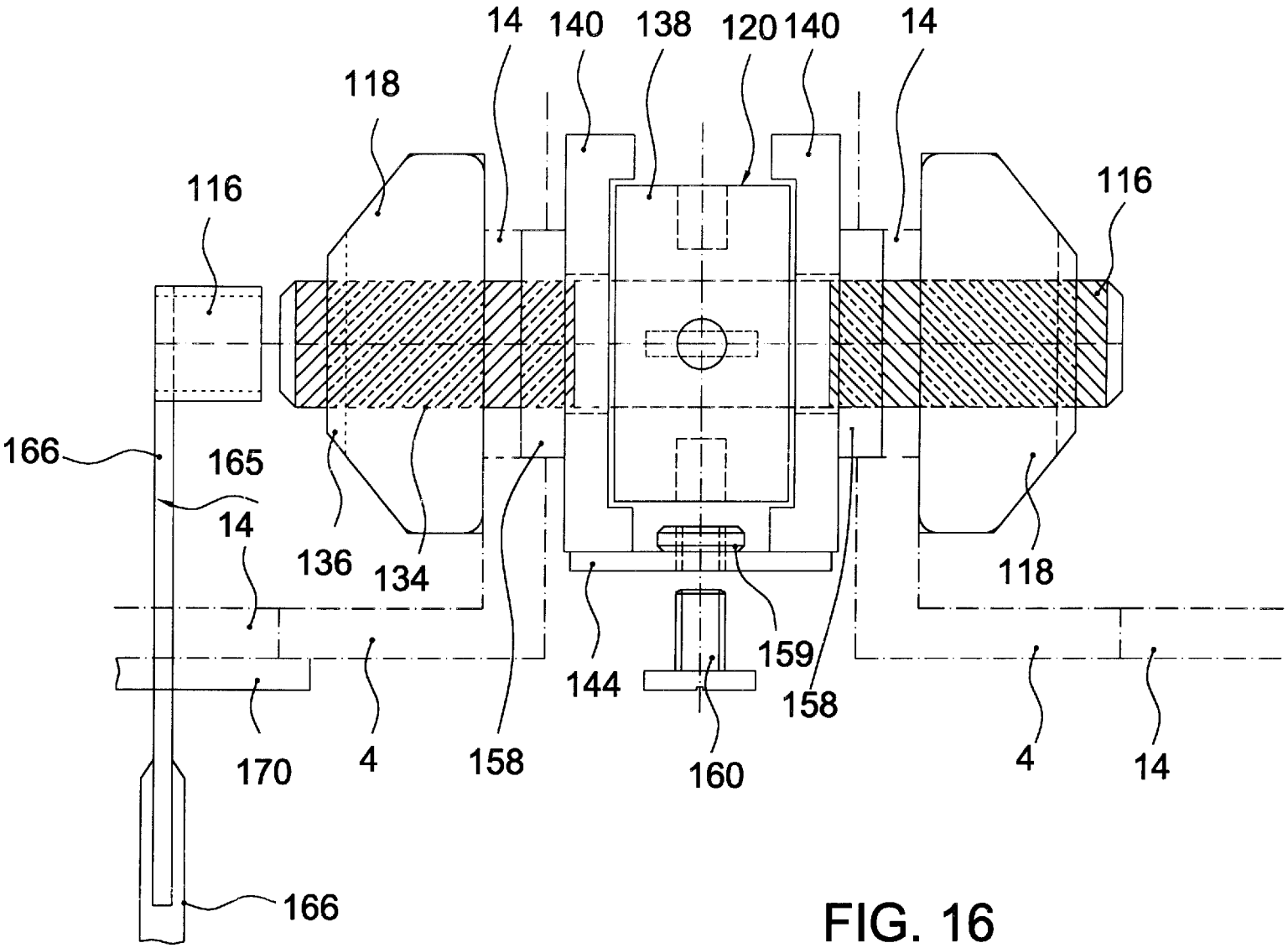
Figure 17:
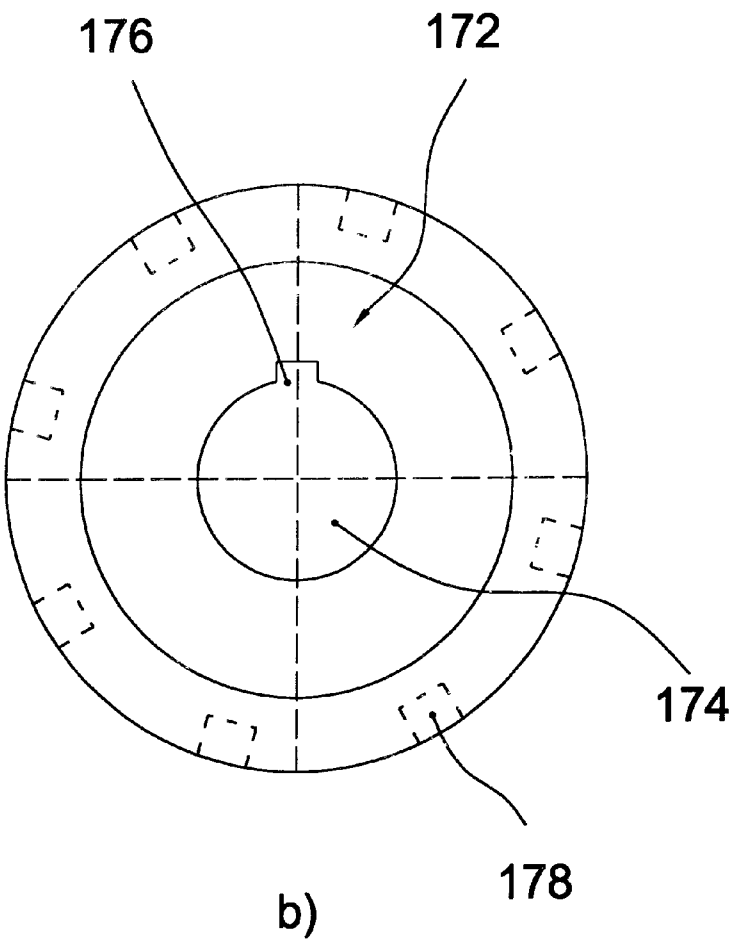
Figure 17:
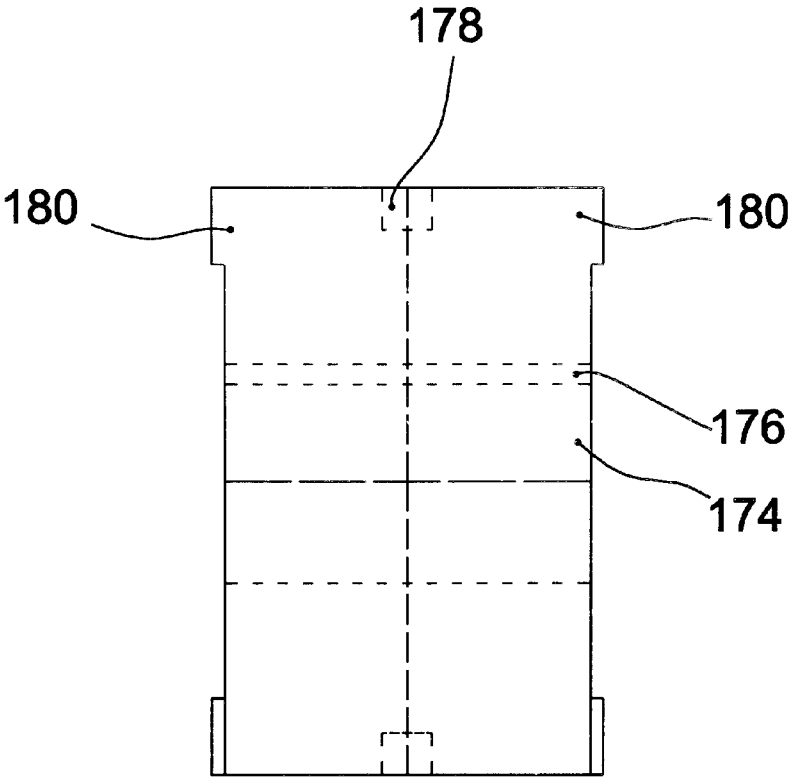
Figure 18:
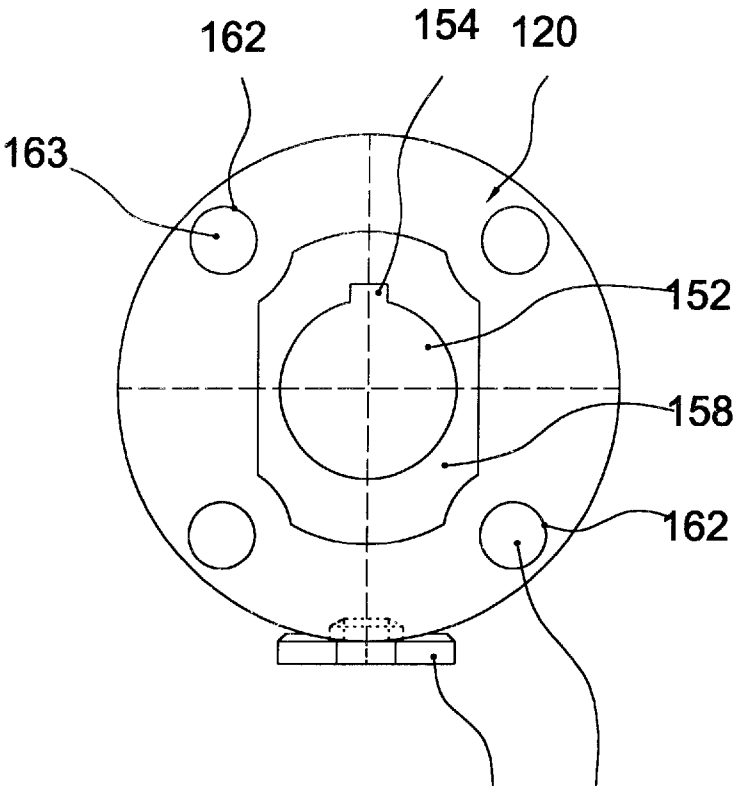
Figure 18:
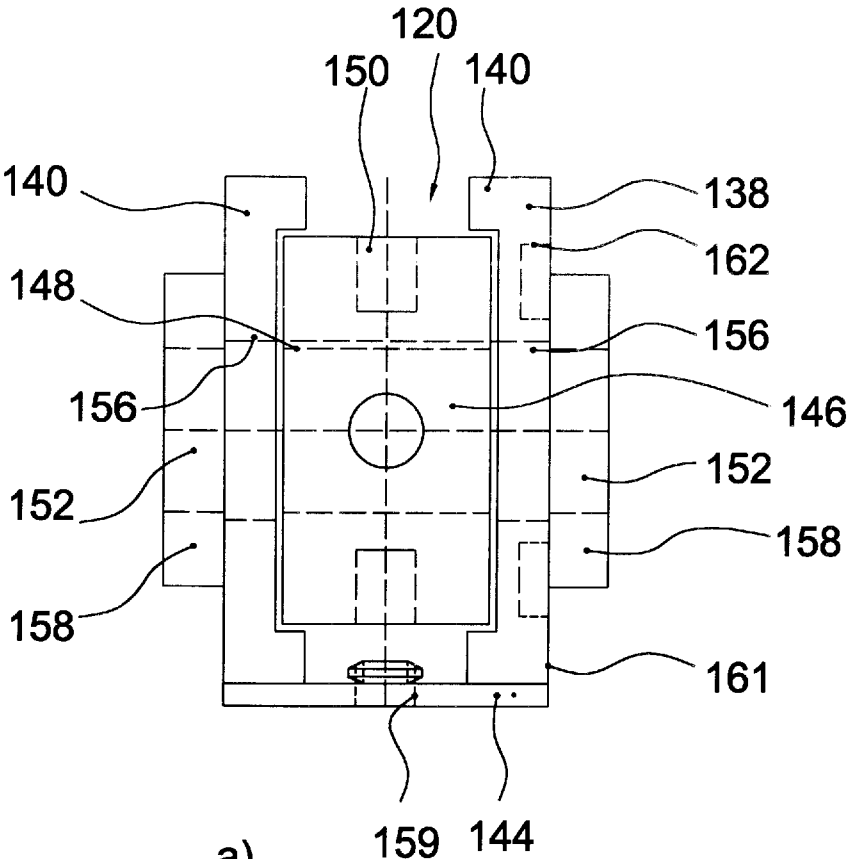
Figure 19:
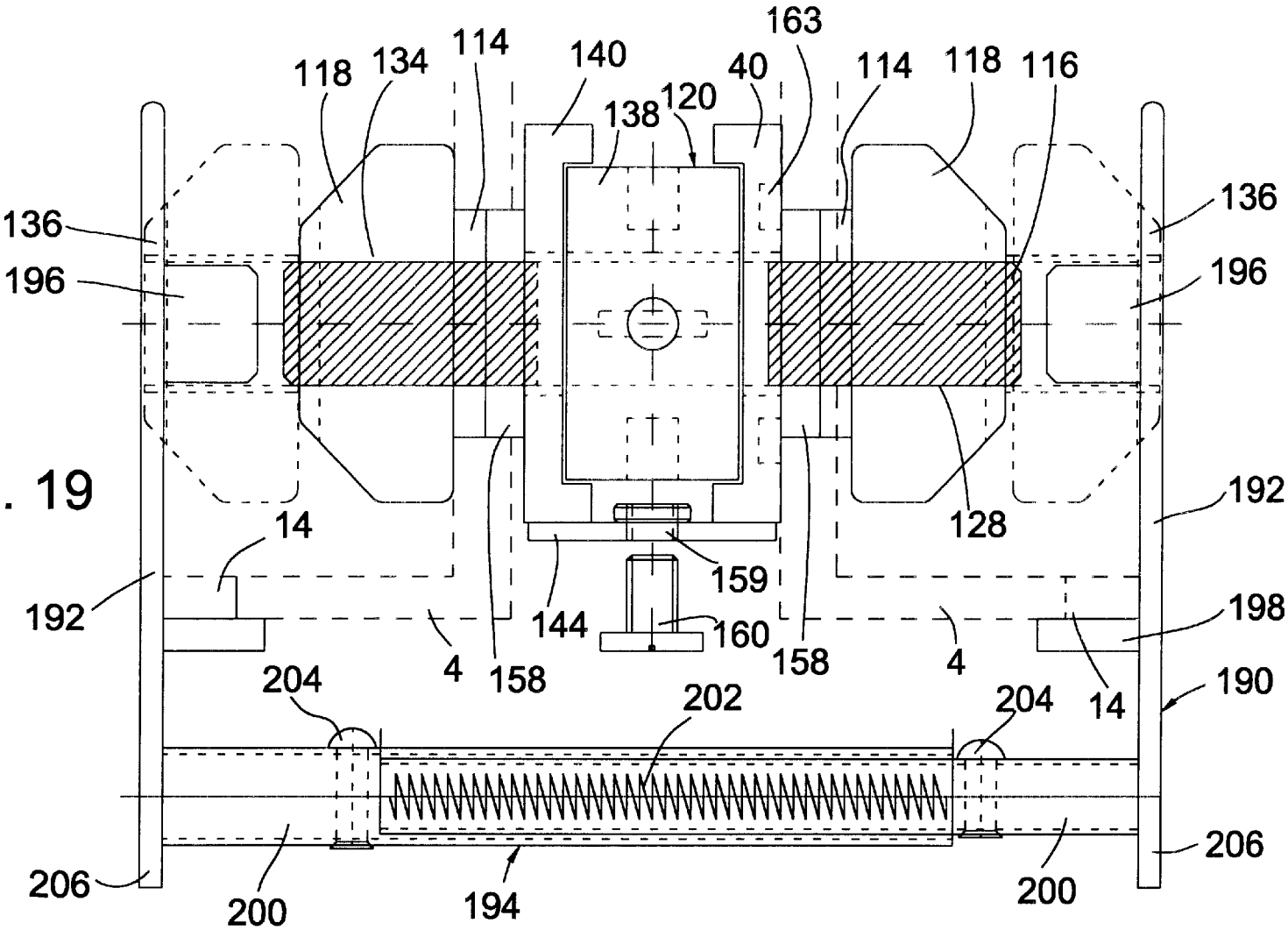
Figure 20:
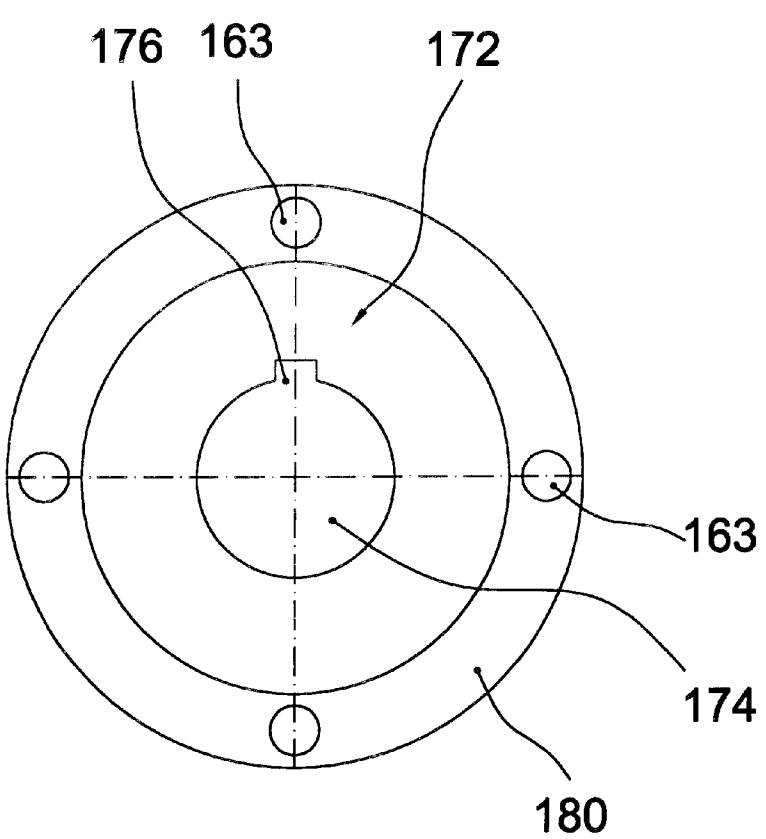
Figure 20:
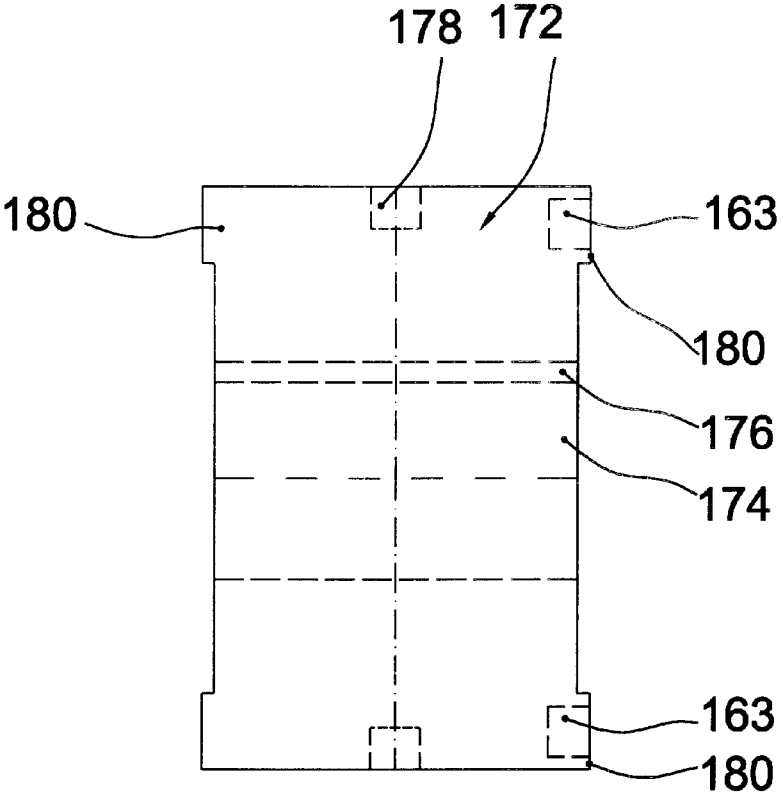
Figure 21:
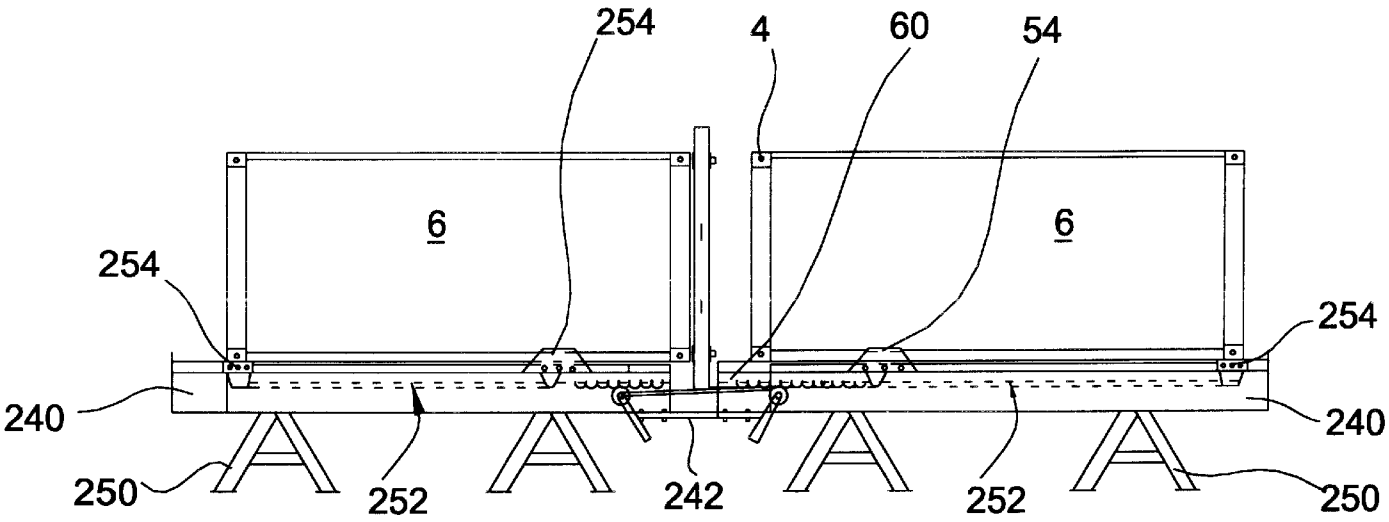
Figure 22:
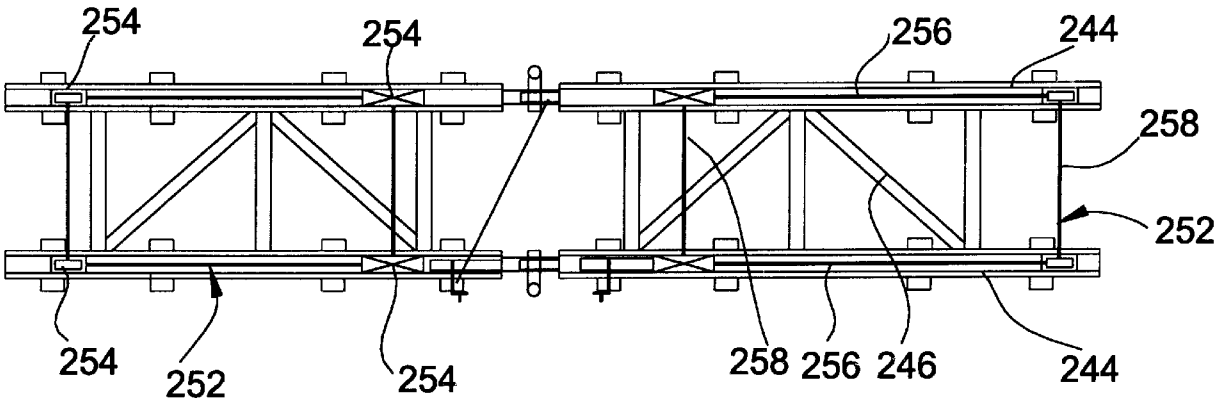
Figure 25:
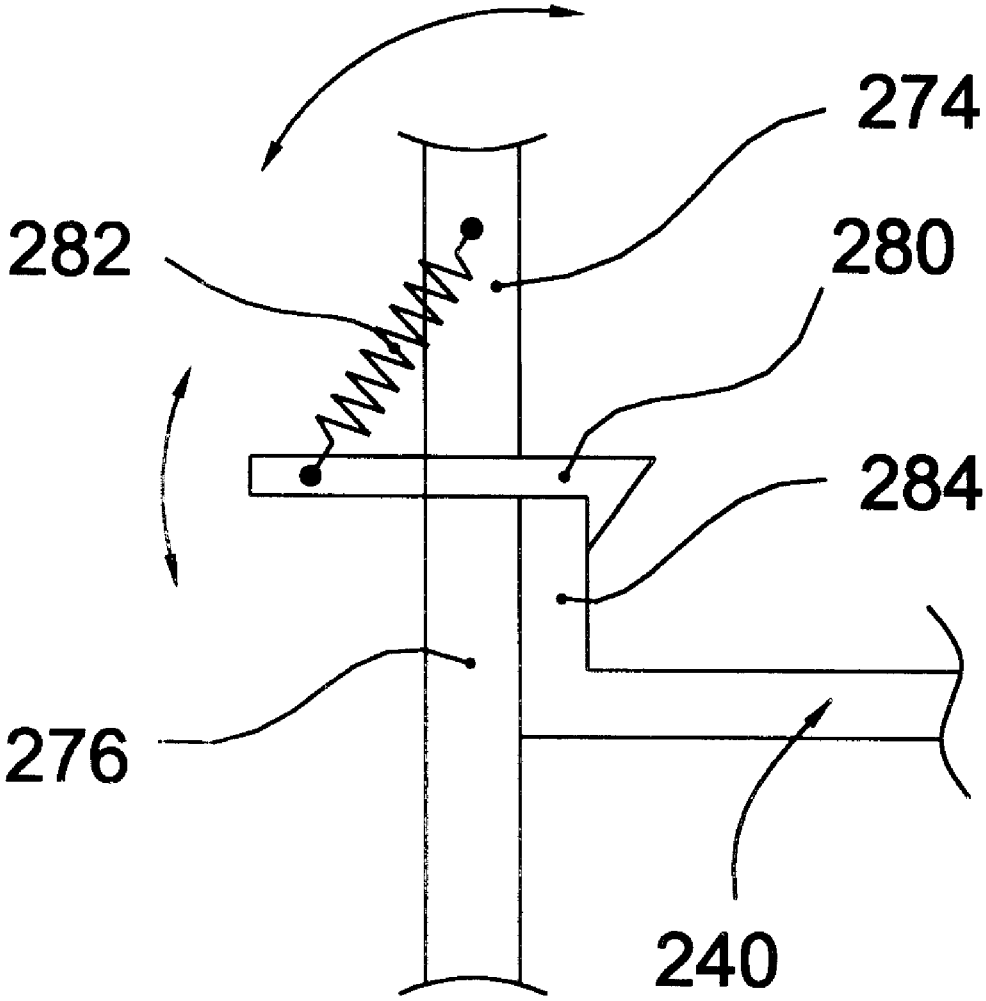

The invention is described by way of example and with further details thereof hereinafter with reference to diagrammatic drawings in which:

FIG. 1 shows side views of a 40-foot container and two 20-foot containers,

FIG. 2 is a partly cut-away perspective view of two 20-foot containers which are to be rigidly connected together and which are arranged with their ends in mutually opposite relationship, FIG. 3 shows a perspective internal view of a composite container, FIG. 4 shows partially sectional side views of kits for rigidly connecting two containers, FIG. 5 shows various details of the kits shown in FIG. 4, FIG. 6 shows detail views of an embodiment, which is modified in comparison with FIG. 5, of a spacer portion and a hammer portion, FIG. 7 shows a composite container which is assembled with a kit including parts as shown in FIG. 6, FIG. 8 is a sectional view of the bottom or floor of a container, FIG. 9 is a side view and a plan view of a modified form of a spacer portion, FIG. 10 is a side view of a screwthreaded rod, FIG. 11 is a side view and a plan view of a hammer portion as can be used for the spacer portion shown in FIG. 9, FIG. 12 is a side view and a plan view of a further embodiment of a spacer portion, FIG. 13 is a plan view of a modified embodiment of a screwthreaded rod, FIG. 14 is a plan view and an end view of a modified hammer portion, FIG. 15 is a plan view and an end view of a modified embodiment of a multi-part spacer portion, FIG. 16 is a partially sectional plan view of an assembled kit with a handling tool, FIG. 17 is a side view and an end view of a further embodiment of a spacer portion, FIG. 18 is a plan view and an end view of a multi-part spacer portion which is slightly modified in comparison with that shown in FIG. 15, FIG. 19 is a partially sectional plan view of an assembled kit with handling tool in an embodiment which is modified in comparison with FIG. 16, FIG. 20 is a side view and an end view of an embodiment of a spacer portion which is modified in comparison with FIG. 17, FIG. 21 is a side view of an apparatus for rigidly connecting two containers, FIG. 22 is a plan view of the apparatus shown in FIG. 21, FIG. 23 is a detail view on an enlarged scale of the apparatus shown in FIG. 21, FIG. 24 is an end view of a portion of the apparatus shown in FIG. 21, and FIG. 25 shows a detail of the apparatus according to the invention.

FIG. 1 shows at the top a side view of a 40-foot container 2 with corner fittings 4 at each corner for lashing down, fixing to a loading apparatus, fixing containers together when stacking them, and so forth. Shown therebeneath are two 20-foot containers 6 which are arranged in such a way that their outer corner fittings 4 are aligned with the corner fittings of the 40-foot container 2 so that in relation to those corner fittings, a unitary lifting apparatus, unitary stacking points and the like could be used if the 20-foot containers 6 were rigidly coupled or connected together in the illustrated position. As can be seen, in the illustrated arrangement, with the present ISO-standardisation of containers, there is a spacing d between the 20-foot containers 6, which is about 76 mm. That spacing d is required for stacking reasons and so forth.

FIG. 2 is a perspective view of two 20-foot containers according to the invention which are disposed with their ends in side-by-side relationship. Those containers 6 are provided in per se known manner with corner fittings 4 and, at their ends which face away from each other as shown in FIG. 2, they have per se known, outwardly opening doors 8 through which the containers 6 are loaded.

At their mutually facing ends, the containers 6 have further doors, with only the doors of the container shown at the right in FIG. 2 being illustrated. That door is shown in the form of a tilting door 10 which is pivotably mounted at the top and which can be opened into the container and which, in the opened condition, bears directly against the roof or top of the container so that it adversely affects the internal space of the container, only to the minimum possible extent. Instead of the tilting door 10 it is also possible to use other kinds of doors such as rolling, rotary or sectional doors. The crucial consideration is that those doors, in the open condition, are completely accommodated in the interior of the container and adversely affect the internal space thereof to the minimum possible extent. Advantageously, the doors 10 at the mutually opposite ends of the containers open completely inwardly and can only be opened from the interior so that they can be opened with containers arranged as shown in FIG. 2.

FIG. 3 shows a perspective view of the interior of the two containers arranged as shown in FIG. 2, with doors 8 that are towards the viewer being open, doors 8 that are remote from the viewer being closed, and with doors 10 (not shown) in an open condition. As can be seen from the drawing, when a rigid connection is made between the two containers, that affords an internal space which corresponds to that of a larger 40-foot container so that the 40-foot container is completely redundant. A further advantage of the composite container shown in FIG. 3 is that it can be loaded from both sides, which accelerates the loading and unloading operations.

FIG. 4 shows a detail view of the mutually facing ends of two containers 6. The basic construction of these containers 6 can be known per se, that is to say for example a frame structure with frame members 12 which extend along the edges and the mutual connection of which is strengthened by means of the corner fittings 4. Each corner fitting 4 is hollow and has at each outside a slot 14 through which the interior of the corner fitting 4 is accessible.

For mutually bracing or for rigidly connecting the containers 6 together, the assembly has a screwthreaded rod 16 with two opposite screwthreads which are in screwing engagement with hammer portions or clamping or tightening members 18 which are accommodated in the hollow spaces of the corner fittings 4. The central region of the screwthreaded rod 16 passes through a spacer portion 20 which is arranged between each two mutually oppositely disposed corner fittings 9. A clamping or tightening sleeve 24 which is non-rotatably connected to the screwthreaded rod 16 and which is provided with radial holes 22 can be actuated through a lateral opening in the spacer portion 20 so that, when the screwthreaded rod 16 is rotated, the hammer portions 18 are moved towards each other and, with the corner fittings 4 being entrained, the containers 6 are rigidly connected with the spacer portion 20 and in mutual relationship. If, as shown in FIG. 3, a continuous interior space is to be provided in the composite container, a peripherally extending hose-type seal (not shown) can be disposed between the frame members 12; the corner portions of the seal are formed for example by shaped portions corresponding to the internal contours of the spacer portions 20. The internal space in the containers 6 can be reliably sealed off from the exterior, by inflating the hose-type seal. It will further be appreciated that the space between the bottoms or floors of the containers can be bridged over by floor plates which are fitted in place or which are hinged to the container bottoms.

FIG. 5 shows some details of the connecting arrangement, in which respect Figures a), b) and c) show a side view, an end view and a plan view of the spacer portion 20, Figure d) shows the passage of the screwthreaded rod 16 through the spacer portion 20 and Figure e) shows the screwthreaded rod 16 with the tightening sleeve 24 and the hammer portions 18, which components form a kit together with the spacer portion 20.

The spacer portion 20 is a hollow member with a through bore 28 through which extends the screwthreaded rod 16, and with a large opening 30 which extend along a narrow side and through which the tightening sleeve 24 can be rotated by means of an actuating pin or tightening 27 which can be introduced into the holes 22 therein. In order to non-rotatably connect the tightening sleeve 24 to the screwthreaded rod 16, at least one cotter pin 32 is fitted into the tightening sleeve 24 and secured therein.

FIG. 6 shows in a) a side view, in b) an end view and in c) a plan view of a modified form of a spacer portion 40, while Figure d) shows an end view of a hammer portion 42.

The main body of the spacer portion 40 is of a similar configuration to the spacer portion 20 (FIG. 5), with a through bore 28 and the lateral opening or openings 30. Above and below the through bore 28 the spacer portion 40 has projections 44 with which it engages in positively locking relationship into the corresponding slots 14 (FIG. 4) in the associated corner fittings 4. Therefore, between the projections 44, an opening 46 extends through between the projections 44, transversely across the through bore 28.

The hammer portions 42 associated with the spacer portion 40 have a screwthreaded through bore 48 and, besides the screwthreaded bore 48, they are provided at their ends with projections 50 which engage into the openings 46.

FIG. 7 shows the entire structural group consisting of the screwthreaded rod 16, the spacer portion 40, the tightening sleeve 24 and the hammer portions 18, with which two corner fittings 4 of mutually adjacent containers 6 are rigidly connected together. The Figure shows the connection of two upper corner fittings 4.

Assembly takes place in the following manner:

The tightening sleeve 24 is introduced into the spacer portion 20, through the openings 30. The screwthreaded rod 16 is inserted through the through bore 28 in the tightening sleeve 24 and non-rotatably connected to the tightening sleeve 24 by means of at least one pin 32. The structural group consisting of the spacer portion 20, the screwthreaded rod 16 and the tightening sleeve 24 is then inserted into a lateral slot 14 for example of the right-hand container 6, in which case the containers are still at a larger spacing than that illustrated. The spacer portion 20 is then non-rotatably connected to the corner fitting 4.

Then, the hammer portion 18 is introduced through an upper lateral slot 14 and fitted onto the end of the screwthreaded rod 16 provided with a screwthread 52, and screwed thereto. When that is done, the hammer portion 18 is moved into a position in which its projections 50 engage into the openings 46 of the spacer portion 20 so that the hammer portion 42 is non-rotatably coupled to the spacer portion 20 and can be further screwed onto the screwthreaded rod 16 by simply continuing to rotate the screwthreaded rod 16, by means of an actuating pin which is fitted into one of the radial holes 22.

Then, the container 6 which is at the left in FIG. 7 is displaced towards the right-hand container so that the left-hand side of the spacer portion 20 engages into the corresponding slot in the upper corner fitting and the two corner fittings or containers are aligned with each other. Then, the other hammer portion 42 is inserted through one of the slots 14 and screwed onto the screwthread of the screwthreaded rod 16. By rotating the screwthreaded rod whose screwthread regions are of opposite hand, the hammer portions 42 are moved towards each other; when that happens the end faces thereof come to bear against the inside walls of the corner fittings 4 and press the corner fittings against the spacer portion 20.

The above-described procedure is effected at the four corners of each of the containers so that the containers can be rigidly and precisely connected together. In accordance with the present ISO-Standard the slots 14 of the upper corner fittings are different from those of the lower corner fittings, which can be taken into account by virtue of adopting a suitable configuration for the projections 44 of the spacer portions 40. The hammer portions 42 can be of the same configuration for all four corner fittings.

After the four tightening screws 16 have been tightened, securing screws (not shown) are screwed in an opening 54 of each spacer portion 40 for rotationally securing the screwthreaded rods 16 which can possibly also be provided with lead customs seals.

FIG. 8 is a view in section through a portion of the bottom or floor 60 of a container, beneath which reinforcing beam members 68 extend. A bottom or floor portion 70 is cut out in a conical configuration between two reinforcing beam members 68. Fitted into the opening which is formed when the floor portion 70 is removed is a storage receptacle or bin 72 which serves to receive two connecting kits with which an upper and a lower corner fitting of a container can be respectively connected to a corresponding upper and lower corner fitting of a further container. The connecting kits each comprise a spacer portion, a tightening sleeve, a screwthreaded rod and two hammer portions and possibly in addition the associated cotter pins and securing screws as well as the tightening pin.

It will be appreciated that numerous modifications in the described arrangement are possible. For example the tightening or clamping sleeve 24 can be omitted and the screwthreaded rod 16 can be directly of such a configuration in its central region that it can be driven in rotation through the spacer portion 20 or 40 respectively, for example by virtue of the screwthreaded rod itself having holes for the insertion of an actuating pin member, or by a worm gear drive being provided between the screwthreaded rod and the spacer portion.

The hammer portions can be of such a configuration that they are introduced directly through the hole behind which they engage after having been rotated. That is readily possible with ISO-standardised corner fittings, in particular at the lower corner fittings, as the slots thereof are of noticeably greater length in comparison with their width. If the hammer portions, the spacer portion and the screwthreaded rod are introduced in that way, then containers which are stacked in a ship can be directly lashed or secured to each other, and that makes the corresponding conventional lashing unnecessary and saves time and money.

The effect of preventing the hammer portions from rotating does not have to be achieved by the hammer portions engaging the spacer portion; the hammer portions may also be provided with projections with which they engage into the slots so that this arrangement affords the rotation-preventing action. The spacer portions can be prevented from rotating by engagement thereof on the hammer portions which in turn are prevented from rotating.

FIG. 9*a* is a side view and FIG. 9*b* is an end view of a modified embodiment of a spacer portion 86. Similarly to the above-described spacer portions, the spacer portion 86 also has a through bore 28 through which the screwthreaded rod 16 can be passed with a close fit, and radial through holes 88 for inserting cotter pins which engage into radial holes 89 in the screwthreaded rod 16 (FIG. 10) and by means of which the spacer portion 86 can be non-rotatably connected to the screwthreaded rod 16, and radial blind holes 22 into which an actuating pin member can be inserted for rotating the spacer portion with the screwthreaded rod 16 non-rotatably connected thereto. The described embodiment of the spacer portion 86 renders redundant the clamping or tightening sleeve which is used in the above-described embodiments for rotating the screwthreaded rod 16. As the above-described spacer portion 86 is rotated when two containers are secured together or when a container is lashed down, and that can result in friction problems at the end, the spacer portion 86 is overall of a three-part construction comprising a central part 90 and two end parts 92 and 94. The end parts 92 and 94 form annular contact surfaces which project slightly relative to the central part 90 and which bear against the central part 90 by way of thrust bearings 96 so that, even when there are high pressure forces acting on the side parts 92 and 94, the central part 90 is rotatable until the screwthreaded rod 16 which engages into the female screwthread in the hammer portions 98 (FIG. 11) no longer permits further tightening.

The tightened condition of the spacer portion 86 or the central part 90 thereof can be secured by a socket-head screw (not shown) being screwed into a screwthreaded bore 10Q from one of the radial holes 22, with the end of the socket-head screw, that is screwed through the screwthreaded bore 100, coming to bear against one of the corner fittings.

The hammer portions 98 used differ from those described above in that they are provided with a projection 102 which positively lockingly engages into an associated slot in a corner fitting and holds it therein, in a condition of being secured to prevent a rotary movement.

An advantage of the spacer portion 86 shown in FIG. 9 is that it is particularly simple to produce, in the form of a turned component which is provided with bores. The thrust bearings 96 can be commercially available bearings which are mounted on the central part in the usual manner.

FIG. 12*a*) is a side view and FIG. 12*b*) is an end view of an embodiment of a spacer portion 104, which is modified in comparison with FIG. 9. The central part 90 is of substantially the same configuration as the central part 90 shown in FIG. 9. The side parts 106 and 108 are provided with projection portions 110 which positively lockingly engage into corresponding slots in the fittings of the containers to be connected so that the side parts 106 and 104 are non-rotatably held in the slots and connect the containers together in alignment with each other. In a corresponding manner, it is possible to use hammer portions which are similar to the hammer portions 42 in FIG. 6*d* with projections 50 and 52 which engage between the projection portions 110.

It will be appreciated that the non-rotational connection between the spacer portion and the hammer portion can also be achieved by means other than cotter pins, for example by means of a bolt or pin member which is inserted or screwed into a through bore in the spacer portion and a through bore aligned therewith, through the screw bolt.

A further embodiment of a set is described hereinafter:

FIG. 13 shows a screwthreaded rod 116 with opposite-hand screwthread regions 128 and a screwthread-less central region, within which there is a radially projecting projection 130 which extends over a part of the axial length of the screwthreaded rod 116.

FIG. 14 shows one of the hammer portions 118, FIG. 14*a* being a plan view and FIG. 14*b* being an end view. As can be seen therefrom, the hammer portion 118 has a through bore 134 provided with a female screwthread 132. In addition the outer end of the hammer portion is provided with a groove 136, the function of which is described hereinafter.

FIG. 15 shows a spacer portion 120 which is composed of a plurality of components and which is modified in comparison with the embodiment shown in FIG. 11, FIG. 15*a* showing a plan view and FIG. 15*b* showing an end view. The spacer portion 120 comprises a total of four parts, namely a central part in the form of a clamping or tightening sleeve 138, two side parts 140 and a bridge part 144.

The tightening sleeve 138 has a through hole 146 which has an axial groove 148 so that the screwthreaded rod 116 can be passed through the tightening sleeve 138 and the projection 130 comes into positively locking engagement with the groove 148. Provided along the periphery of the tightening sleeve 138 are radial holes 150 for fitting a tool by means of which the tightening sleeve 138 can be rotated.

Each of the side parts, which are the same as each other, has a through bore 152 with a groove 154 so that the screwthreaded rod 116 can be pushed through the side part. In a region 156 adjacent the tightening sleeve 138, the through bore 152 is enlarged and is of an inside diameter which is so great that the screwthreaded rod 116 which is passed through the side part 140 can rotate relative to the side part when the projection 130 is within the enlarged region 156. At the end which is towards the tightening sleeve 138 in the assembled condition, the side part 140 is provided with a recess for receiving the tightening sleeve 138. At the outer end which faces away, the side part 140 has a projection 158 for positively locking engagement into one of the slots 14 of a corner fitting 4.

A bridge 144 serves for rigidly connecting the two side parts 140 together, with the tightening sleeve 138 accommodated between them. The bridge 144 can be for example screwed or welded to each of the side parts 140 and has a screwthreaded bore 159 into which the securing screw 160 (FIG. 16) can be screwed.

Before the function of the described components is explained with reference to FIG. 16, a handling tool identified by reference 165 in FIG. 16 will also be described.

The handling tool 165 has a holding arm or limb 166, one end of which is in the form of a handle 167 while the other end carries a bush or sleeve portion 168 whose outside diameter corresponds to the inside diameter of the through bore 134 in a hammer portion 118. The holding limb 166 is of such a cross-sectional configuration that it fits into the groove 136 at the end of the hammer portion 118. In addition, provided on the holding limb 166 is an abutment 170 which, when the sleeve portion 168 is aligned with the through bore 134, bears against the outside of the corner fitting 4 which is shown in dash-dotted line in FIG. 16.

The mode of operation of the described components is as follows:

The two side parts 140 which accommodate the tightening sleeve 138 between them are rigidly connected together by way of the bridge portion 144 so that they form the spacer portion 120. In the assembled condition the tightening sleeve 138 is accommodated between the side parts 140, practically without axial play. The screwthreaded rod 116 is inserted into the structural group formed in that way, in which case the screwthreaded rod 116, in the inserted condition, after a slight rotary movement, can be axially displaced within the spacer portion 120 by a distance which is determined by the projection 130 bearing against the end of the enlarged region 156 of the bore in the left-hand or right-hand side part 140 respectively. Over its entire axial range of displacement, the screwthreaded rod 116 is non-rotatably connected to the tightening sleeve 138 by virtue of the projection 130 engaging into the groove 154 in the tightening sleeve 138. An end of the screwthreaded rod 116 which projects out of the spacer portion 120 is then introduced through a suitable slot 14 into a corner fitting 4 of one of the containers to be connected. A hammer portion 118 is introduced into the interior of the corner fitting 4 through another of the slots 114 of the corner fitting 4, being held by means of the handling tool 162, and is fitted to the screwthreaded rod 116. By rotation of the tightening sleeve 138 the screwthread of the screwthreaded rod 116 comes into engagement with the screwthread of the hammer portion 118 so that the handling tool 162 can be removed. It should be pointed out that, upon insertion of the handling tool 165 with hammer portion 118 fitted thereto, the abutment 170 comes to bear against the outside of the corner fitting 4; in that position, alignment is guaranteed at least in one direction, between the hammer portion 118 and the screwthreaded rod 116. Full alignment as between the hammer portion 118 and the screwthreaded rod 116 can be guaranteed by virtue of the abutment 170 being of a suitable configuration for that purpose.

The two containers which are to be connected together are at the latest now moved towards each other to such an extent that the screwthreaded rod 116 projects with its other end into the other corner fitting, whereupon the other hammer portion 118 is introduced in a similar manner by means of the handling tool 165 and is brought into screwthreaded engagement with the screwthreaded rod 116. The tightening sleeve 138 is now further rotated, in which case the side parts 140 are held non-rotatably by virtue of the positively locking engagement between the projections 158 and the slots 14 of the corner fittings 4. When the tightening sleeve 138 is rotated the hammer portions 118 are moved towards each other by virtue of the screwthreaded engagement with the opposite-hand screwthreaded regions of the screwthreaded rod 116, and come to bear against the insides of the corner fittings 4 whereby the corner fittings or containers are moved towards each other and come to bear firmly against the outsides of the spacer portion or the side parts 140 thereof. An axial thrust bearing may possibly be provided between the side parts 140 and the tightening sleeve 138; it has been found however that this is not necessary, but that the tightening sleeve 138 can be rotated, even without a bearing arrangement, to such an extent as to provide a rigid firm connection between the two containers. It will be appreciated that additional measures may be provided to prevent the hammer portions 118 from rotating, for example the handling tool 165 can be of such a configuration that it engages with its holding limbs 166 into the groove 136 and thereby provides a rotation-preventing effect, or the sleeve portion 168 can engage with a rotation-preventing cross-section into the hammer portion 118 or the hammer portion 118 can be provided with projections, similarly to the projections 158, which engage into the corresponding slot 14. The axial displaceability of the screwthreaded rod 116 relative to the spacer portion 120 ensures that uniform adaptation is guaranteed, even in the event of the tightening sleeves 138 being asymmetrically screwed on.

After the two containers are rigidly connected together by tightening the screwthreaded rod 116 or after the tightening sleeve 138 has been sufficiently further rotated, the tightening sleeve is secured to prevent rotation thereof, by the securing screw 160 being screwed into the bridge portion 144 until it engages into one of the holes 150 in the outer peripheral surface of the tightening sleeve 138 (FIG. 15).

FIG. 17 shows an embodiment of a spacer portion 172 which is considerably simplified in comparison with FIG. 15, FIG. 17*a* showing a side view and FIG. 17*b* showing an end view. The spacer portion 172 is of a one-part construction and serves directly also as a tightening sleeve. It has an axial through bore 174 with a groove 176 so that the screwthreaded rod 116 (FIG. 13) can be pushed through the spacer portion 172 but it is non-rotatably connected to the spacer portion 172 when the projection 130 is within the groove 176. At its periphery the spacer portion 172 has uniformly distributed holes 178 for the insertion of a turning tool. At its two ends the spacer portion 172 is provided with slightly projecting annular flanges 180 for bearing against the corner fittings of the containers which are to be connected together.

The mode of operation or the co-operation of the spacer portion 172 with the screwthreaded rod 116 and the hammer portions 118 is similar to that described above, but in this case the screwthreaded rod 116 is not directly limited in regard to its axial mobility relative to the spacer portion 172 and additional steps must be taken to prevent the spacer portion 172 from rotating in the assembled condition of the containers, for example an inclined bore through which a securing screw can be screwed, to engage a corner fitting.

FIG. 18 shows a spacer portion 120 which is substantially the same as that shown in FIG. 15, with the exception that provided in the end 161 of the right-hand side part 140, which is at the right in FIG. 18, are four bores 162 into which permanent magnets 163 are fixedly fitted, for example by gluing, by being a shrink fit therein, by screwing or the like. The permanent magnets whose diameter is for example 18 mm and which are 6 mm long terminate flush with the end face 161.

Before the function of the spacer portion as shown in FIG. 18 is described with reference to FIG. 19, a handling tool which is identified by reference 190 in FIG. 19 and which permits even more convenient operation in comparison with that shown in FIG. 16 will also be described:

The handling tool 190 has two holding arms or limbs 192 which are connected by way of a base 194 so that it is of an overall U-shaped configuration. Each holding limb 192 carries a bush or sleeve portion 196 whose outside diameter corresponds to the inside diameter of the through bore 134 of a hammer portion 118. The cross-section of each holding limb 192 is of such a size that the limb fits into the groove 136 at the end of the hammer portion 118. In addition, provided on each holding limb 192 is an abutment 198 which, when the sleeve portion 196 is aligned with the through bore 134 or the axis of the screwthreaded rod 116, bears against the outside of the corner fitting 4 which is shown in dash-dotted line. Alternatively, the abutments 198 can be omitted and can be formed by the front ends of the holding limbs 192 bearing against the insides (not shown) of the corner fittings 4.

The base 194 of the handling tool 190 is formed by two support profile portions 200 which are guided one within the other and which are rigidly connected to the holding limbs 192 and which are pulled towards each other by means of a spring. The spring 202 is connected for example to pin members 204 which extend through the support profile portions 200. The holding limbs 192 have extension portions 206 which project beyond the base 194 and which can be shaped to provide handles which improve the handlability of the handling tool.

The mode of operation of the kit corresponds to that of the embodiment shown in FIG. 16, with the exception of the options afforded by the magnets 163 and the modified design configuration of the handling tool 190.

Referring to FIG. 19 the structural group consisting of the spacer portion 120 and the screwthreaded rod 116 is introduced with one end of the screwthreaded rod 116 through a slot 114 into a corner fitting 4 of one of the containers to be connected. In that case in the illustrated example, the end of the right-hand side part 140 comes to bear against the corner fitting 4, while the permanent magnets 163 hold the structure group consisting of the spacer portion 120 and the screwthreaded rod 116 to the right-hand corner fitting 4.

The left-hand container is now moved towards the right-hand container to such a degree that the screwthreaded rod 116 projects into the left-hand corner fitting 4. Now, the two hammer portions 118 (shown in broken line) which are fitted onto the sleeve portions 196 of the handling tool 190 are introduced through the lateral slots 14 into the respective corner fitting 4, with the holding limbs 192 being pulled apart, thereby stressing the spring 202. Due to the stress in the spring 202, when the abutments 198 bear against the corner fittings 4 the hammer portions 118 automatically come to bear against the ends of the screwthreaded rod 116; they retain that position without the handling tool 190 having to be further held. By rotation of the tightening sleeve 138 the containers are then rigidly connected together in the described manner, in which case the described procedure, that is to say at least fitting the structural groups consisting of spacer portion 120 and screwthreaded rod 116 to all four corners of the containers, is effected before they are moved towards each other.

FIG. 20 shows an embodiment of the spacer portion which corresponds to that shown in FIG. 17 with the only difference that provided in the end face of one of the annular flanges 180 are permanent magnets 163 which have the same function as the permanent magnets in the above-described embodiment of FIG. 19.

Reference will now be made to FIGS. 21 to 25 to describe hereinafter an apparatus with which containers can be coupled to form a composite container, using the above-described kits:

Looking at FIG. 21, two platforms 240 are rigidly connected together by means of connecting struts 242. The platforms 240 comprise two I-section bearers 244 (FIG. 24) which are assembled by means of bracing structs 246 to form a main frame structure which is rigid in itself and which rests on supports 250. The entire arrangement is such that the top sides of the I-section bearers are in one plane.

Disposed on each of the platforms 240 is a carriage-like or cartlike support arrangement 252 which is formed from four roller units 254 movably guided on the I-section bears 244, the units 254 being rigidly connected together by means of longitudinal and transverse structs 256 and 258. The two support arrangements 258 are so dimensioned that a container 6 can be fitted onto each support arrangement 252, in which case the two outer corner fittings of the containers 6 can be brought into engagement with the outer roller units 254 so that they are non-displaceably resting thereon.

Provided for lengthwise movement of the support arrangements 252 is a motion device 260 which is of the following construction (see in particular FIG. 23):

Fixed to the mutually facing ends of the movable support arrangements 252 is a respective rack 262 meshing with a gear 264 mounted on the platform 240. The gears 264 are rotatable by means of cranks 266 and are optionally coupled together by way of a connecting rod 268 in such a way that they rotate in opposite directions.

Two holding devices 272 (see FIG. 24) are provided for presenting or holding the structural group 270 consisting of the screwthreaded rod and the spacer portion. Each of the holding devices 272 has an arm 274 which is mounted pivotably at a trunnion or pin 276 on the platforms 240 or the connecting structs 242 thereof. Each arm has two spring loop units 278 into which can be fitted the structural group 270 comprising a spacer portion and a screwthreaded rod passing through the spacer portion.

Each of the pivotable arms 274 is pivotable from a loading position (not shown) in which it is pivoted horizontally outwardly into an operative position in which it is disposed perpendicularly upwardly and is held in a condition of defined contact against an abutment 284 which is fixed with respect to the platform (see FIG. 25), by means of a retaining lever 280 which is pivotably mounted on the arm and which is biased by a spring 282.

The mode of operation of the described apparatus is as follows:

With the support arrangements 252 in the condition of being moved away from each other, a container 6 is put onto each support arrangement, for example by means of a crane or a lifting truck. After release of the retaining lever 280 the arms 274 are pivoted outwardly and a structural group 270 comprising a screwthread rod and the spacer portion is introduced into each of the spring loop units 278. The arms 274 are then pivoted upwardly in a perpendicular direction, in which case they are latched in a well-defined position by means of the retaining lever 280. The containers are now moved towards each other by actuation of one of the cranks 266, to such an extent that the screwthreaded rods of the structural groups 270 project through the slots of the corner fittings 4 into same. In that operation, it is advantageous that the centre between the containers that are moved towards each other remains stationary. Now, hammer portions 224 are introduced into the interior of the fittings 4, for example by means of handling tools as described with reference to FIGS. 16 to 19, and are brought into screwthreaded engagement with the screwthreaded rods by rotation of the tightening sleeves of the structural groups 270 (the spring loops only engage the side parts). After release of the retaining lever 280 the arms 274 can be pivoted outwardly for the sake of better accessibility to the tightening sleeves, whereupon the tightening sleeves are rotated until the corner fittings 4 come to bear firmly against the spacer portions and the containers 6 are rigidly connected together. The entire procedure can be performed with a high degree of precision in an extremely comfortable and convenient and simple manner so that, with the apparatus according to the invention, two containers can be inexpensively connected together or, if the described operations are performed in the reverse sequence, the containers can be separated from each other.

It will be appreciated that numerous modifications in the described apparatus are possible. For example a motor drive for the tightening sleeves can be integrated into the spring loop units 278. Likewise the pivotal movement of the arms 274 and the drive for the pinions or gears 264 can be produced by motor means so that even faster and more comfortable operation is possible. The spring loop units 78 can be enlarged in such a way that they have further pivotal arms provided on them, which arms can also be motor-operated, whereby the hammer portions can be introduced into the interior of the corner fittings so that the entire operation of the apparatus can be effected in an automated mode or under central control.

If units with magnets as shown in FIG. 18 or FIG. 20 are used, the arms 274 can be entirely omitted.

It is also possible for containers other than 20-foot containers to be connected together, for example four 10-foot containers to form a 40-foot container, two 10-foot containers to form a 20-foot container, and so forth.

What is claimed is:

1. A kit for rigidly connecting two containers (6) provided at their corners with hollow corner fittings (4), wherein the corner fittings are provided with slots (14) through which their interior is accessible from the exterior of the container, comprising:

a spacer portion (20; 40; 120; 172; 186) for abutment on the outer surfaces of corner fittings of two containers to be connected and facing to each other which spacer portion, when the containers (6) are rigidly connected together, ensures a predetermined spacing between them;

two hammer portions (18; 42; 118) either of which can be introduced into the interior of a respective one of the corner fittings of two containers to be connected and facing to each other, said hammer portions being formed as to overlap with the corresponding inside walls of the corner fittings;

screwthreaded engaging means by which the hammer portions can be moved towards each other thereby pressing the outside of the corner fittings against the spacer portion, wherein said screwthreaded engaging means is provided by a screwthreaded rod (16; 116) which has at its end regions screwheads adapted to be screwed into respective screwthreaded holes of the hammer portions (18; 42; 118)

which screwthreaded rod passes, with said components adapted to be assembled for rigidly connecting the containers, through the spacer portion and is rotatable from outside the spacer portion and upon rotation moves towards each other the hammer portions which have been introduced into the interior of the corner fittings (4) through slots (14) formed in their side faces; and a tightening sleeve (24; 138) non-rotatably connected to the screwthreaded rod (16; 116), wherein the screwthreaded rod and the tightening sleeve in an assembled state are arranged within the spacer portion (20; 40; 120) and are rotationally driven from outside the spacer portion by means of a tool, wherein said spacer portion (120) is provided with an opening (159) for insertion of a locking screw (160) to prevent the tightening sleeve (138) from rotating.

2. A kit for rigidly connecting two containers (6) provided at their corners with hollow corner fittings (4), wherein the corner fittings are provided with slots (14) through which their interior is accessible from the exterior of the container, comprising:

a spacer portion (20; 40; 120; 172; 186) for abutment on the outer surfaces of corner fittings of two containers to be connected and facing to each other which spacer portion, when the containers (6) are rigidly connected together, ensures a predetermined spacing between them;

two hammer portions (18; 42; 118) either of which can be introduced into the interior of a respective one of the corner fittings of two containers to be connected and facing to each other, said hammer portions being formed as to overlap with the corresponding inside walls of the corner fittings;

screwthreaded engaging means by which the hammer portions can be moved towards each other thereby pressing the outside of the corner fittings against the spacer portion, wherein said screwthreaded engaging means is provided by a screwthreaded rod (16; 116) which has at its end regions screwheads adapted to be screwed into respective screwthreaded holes of the hammer portions (18; 42; 118)

which screwthreaded rod passes, with said components adapted to be assembled for rigidly connecting the containers, through the spacer portion and is rotatable from outside the spacer portion and upon rotation moves towards each other the hammer portions which have been introduced into the interior of the corner fittings (4) through slots (14) formed in their side faces;

wherein said spacer portion (86; 120; 172) can be non-rotatably connected to the screwthreaded rod (16; 116) and at its outside periphery, is of such a configuration that it is drivable in rotation by means of a tool, wherein the screwthreaded rod (116) is axially movably accommodated in the spacer portion (120; 172).

3. A kit for rigidly connecting two containers (6) provided at their corners with hollow corner fittings (4), wherein the corner fittings are provided with slots (14) through which their interior is accessible from the exterior of the container, comprising:

a spacer portion (20; 40; 120; 172; 186) for abutment on the outer surfaces of corner fittings of two containers to be connected and facing to each other which spacer portion, when the containers (6) are rigidly connected together, ensures a predetermined spacing between them;

two hammer portions (18; 42; 118) either of which can be introduced into the interior of a respective one of the corner fittings of two containers to be connected and facing to each other, said hammer portions being formed as to overlap with the corresponding inside walls of the corner fittings;

screwthreaded engaging means by which the hammer portions can be moved towards each other thereby pressing the outside of the corner fittings against the spacer portion, wherein said screwthreaded engaging means is provided by a screwthreaded rod (16; 116) which has at its end regions screwheads adapted to be screwed into respective screwthreaded holes of the hammer portions (18; 42; 118)

which screwthreaded rod passes, with said components adapted to be assembled for rigidly connecting the containers, through the spacer portion and is rotatable from outside the spacer portion and upon rotation moves towards each other the hammer portions which have been introduced into the interior of the corner fittings (4) through slots (14) formed in their side faces, wherein the spacer portion (120) has a central part (138) which at its outside periphery is of such configuration that it is drivable in rotation by means of a tool and is connected non-rotatably but axially movably to the screwthreaded rod (116), and a respective side part (140) on each side of the central part for bearing against a respective corner fitting (4) of the containers to be connected together.

4. A kit for rigidly connecting two containers (6) provided at their corners with hollow corner fittings (4), wherein the corner fittings are provided with slots (14) through which their interior is accessible from the exterior of the container, comprising:

a spacer portion (20; 40; 120; 172; 186) for abutment on the outer surfaces of corner fittings of two containers to be connected and facing to each other which spacer portion, when the containers (6) are rigidly connected together, ensures a predetermined spacing between them;

two hammer portions (18; 42; 118) either of which can be introduced into the interior of a respective one of the corner fittings of two containers to be connected and facing to each other, said hammer portions being formed as to overlap with the corresponding inside walls of the corner fittings;

screwthreaded engaging means by which the hammer portions can be moved towards each other thereby pressing the outside of the corner fittings against the spacer portion, wherein said screwthreaded engaging means is provided by a screwthreaded rod (16; 116) which has at its end regions screwheads adapted to be screwed into respective screwthreaded holes of the hammer portions (18; 42; 118)

which screwthreaded rod passes, with said components adapted to be assembled for rigidly connecting the containers, through the spacer portion and is rotatable from outside the spacer portion and upon rotation moves towards each other the hammer portions which have been introduced into the interior of the corner fittings (4) through slots (14) formed in their side faces, wherein the spacer portion (120; 172), at at least one of its ends towards a corner fitting (4), is provided with at least one permanent magnet (163) which holds the structural group comprising the screwthreaded rod (116) and the spacer portion (120; 172) in contact against the associated corner fitting (4).

5. A kit according to claim 1, wherein in its central region the screwthreaded rod (116) has a projection (130) which engages into a longitudinal groove (135; 154; 176) in the spacer portion (120; 172), said longitudinal groove being of a configuration corresponding to the cross-section of the projections.

6. A kit according to claim 2, wherein the side parts (140) are directly connected together by means of a bridge portion (144) so that the multi-part spacer portion forms a pre-assembled unit.

7. A kit according to claim 2 wherein a longitudinal groove (157) is provided only in the axially outer region of the side parts (140) and the radius of a through bore for receiving the screwthreaded rod (116) in the axially inner region (156) of the side parts (140) is at least as large as the radius of the screwthreaded rod in the region of a projection (130) formed on the screwthreaded rod for an engagement into said longitudinal groove.

8. A kit according to claim 6, wherein the bridge portion (144) has a screwthreaded bore (159) for screwing in a securing screw (160) for preventing the central part (138) from rotating in the screwed-in condition.

9. A kit according to claim 4, wherein extending from the end of the spacer portion (120; 172) are bores (162) which are arranged around the axis of the screwthreaded rod (116) and into each of which is fitted a respective permanent magnet (163).

10. A handling tool for fitting a hammer portion (118) of a kit according to claim 1 through a slot (14) of a corner fitting onto one end of the screwthreaded rod (116) projecting into the corner fitting, which handling tool (165; 190) has a holding limb (166; 192) with a sleeve portion 168; 196) for insertion into a through bore (134) in the hammer portion (118), in such a way that the hammer portion which is fitted onto the sleeve portion is movable through a slot (14) of the corner fitting (4), said handling tool having an abutment (170; 198) which is provided on the holding limb (166; 192) and which aligns the sleeve portion (168; 198) in a position of alignment with respect to the screwthreaded rod (116), wherein the holding limb (166,192) engages into a groove (136) at the rear side of the hammer portion (118).

11. A handling tool according to claim 10, wherein the handling tool (190) is of an overall U-shaped configuration, at each end of its holding limbs (192) it has a sleeve portion (178) for introduction into a through bore (134) in a respective hammer portion (118), and at its base (194) it is of such a configuration that the limbs are not rotatable relative to each other but are movable away from each other, under elastic prestressing.

* * * * *

UNITED STATES PATENT AND TRADEMARK OFFICE

CERTIFICATE OF CORRECTION

PATENT NO. : 6,363,586 B1
DATED : April 2, 2002
INVENTOR(S) : Neufingerl

It is certified that error appears in the above-identified patent and that said Letters Patent is hereby corrected as shown below:

Title page,
Item [54], should read as follows:

[54], Title: -- KIT FOR RIGIDLY CONNECTING TWO CONTAINERS PROVIDED AT THEIR CORNERS WITH HOLLOW CORNER FITTINGS AND HANDLING TOOL CONTAINER AND APPARATUS --

Signed and Sealed this

Twenty-seventh Day of August, 2002

*Attest:*

*Attesting Officer*

JAMES E. ROGAN
*Director of the United States Patent and Trademark Office*